US005497308A

United States Patent [19]

Ohtsuka et al.

[11] Patent Number: 5,497,308

[45] Date of Patent: Mar. 5, 1996

[54] VEHICULAR LAMP

[75] Inventors: Yasushi Ohtsuka; Masataka Choji; Yoshiyuki Fukushima, all of Shizuoka, Japan

[73] Assignee: Koito Manufacturing Co., Ltd., Tokyo, Japan

[21] Appl. No.: 433,208

[22] Filed: May 2, 1995

[30] Foreign Application Priority Data

May 9, 1994 [JP] Japan ..... 6-117376
Nov. 10, 1994 [JP] Japan ..... 6-300207

[51] Int. Cl.[6] ..... F21V 29/00

[52] U.S. Cl. ..... 362/294; 362/61; 362/345; 362/373

[58] Field of Search ..... 362/61, 80, 294, 362/345, 310, 373

[56] References Cited

U.S. PATENT DOCUMENTS

| | | | |
|---|---|---|---|
| 4,405,974 | 9/1983 | Quiogue | 362/294 |
| 4,739,458 | 4/1988 | Yamayoshi et al. | 362/294 |
| 4,862,337 | 8/1989 | Ohshio et al. | 362/294 |
| 4,937,710 | 6/1990 | Hurley et al. | 362/294 |
| 5,010,453 | 4/1991 | Ketterman | 362/61 |
| 5,041,949 | 8/1991 | Hirota et al. | 362/61 |

FOREIGN PATENT DOCUMENTS 60-26702 2/1985 Japan .

*Primary Examiner*—Stephen F. Husar
*Attorney, Agent, or Firm*—Sughrue, Mion, Zinn, Macpeak & Seas

[57] ABSTRACT

A ventilation system for a vehicular lamp including a communication hole formed in the vehicular lamp; a first peripheral wall projecting from a rear surface of the lamp at a position where said first peripheral wall surrounds said communication hole; an upper and lower water preventive walls projecting from said first peripheral wall downwardly of said communication hole; a second peripheral wall surrounding said first peripheral wall, said second peripheral wall projecting from the rear surface of the lamp; a lid member engaging with said second peripheral wall for covering said first and second peripheral walls; a first space defined between the lamp, said lid member and said first peripheral wall, said first space communicating through said communication hole with the lamp chamber; a second space defined between the lamp, said lid member and said upper and lower water preventive walls, said second space communicating with said first space through a first communication passage formed at a first position in the lateral direction; and a third space defined between the lamp, said lid member, said lower water preventive wall and said second peripheral wall, said third space communicating with said second space through a second communication passage formed at a second position opposite to said first position, said third space communicating with atmosphere.

10 Claims, 20 Drawing Sheets

1
2
9
10
7
11₁
11₂
14u
16u
13
18
15u
14
14ℓ
16ℓ
16d
16r
12
14r
15d

VEHICULAR LAMP

BACKGROUND OF THE INVENTION

1. Field of the Invention

The present invention relates to a novel vehicular lamp and, more particularly, it relates to an improved vehicular lamp having a ventilation system including an air communication hole for communicating a lamp chamber with the atmosphere to prevent a lens and a reflecting surface from getting fogged, so that air smoothly flows in and out and water is difficult to enter the lamp chamber.

2. Related Art

There has been known a conventional vehicular lamp having a ventilation system including a communication hole for communicating a lamp chamber with the atmosphere to prevent a lens and a reflecting surface from getting fogged.

FIG. 1 shows an example of a conventional vehicular lamp a1 of this type.

As shown in FIG. 1, a lamp body b1 includes a front opening which is covered with a lens c1 to thereby form a substantially tightly closed lamp chamber d1. A bulb e1 is disposed within the lamp chamber d1 and mounted to the lamp body b1.

A communication hole f1 is formed in the rear wall of the lamp body b1, and a cylindrical communication pipe g1 is provided backwardly from the peripheral edge of the communication hole f1. A water preventive pipe h1 has an almost L-shaped side surface and one end portion of the water preventive pipe h1 connects to the communication pipe g1 in such a manner that it is fitted over the communication pipe g1.

In the conventional vehicular lamp a1, air flows into the lamp chamber d1 from the waterproof pipe h1 through the communication hole f1, which is intended to prevent the lens c1 an the like from getting fogged. Since the waterproof pipe h1 having an almost L-shaped side surface is mounted over the communication pipe g1, water coming from the outside is difficult to enter the lamp chamber d1.

However, the conventional vehicular lamp as described above suffers from a problem that the number of parts is large and the manufacturing cost is rather expensive because it requires the separate waterproof pipe h1.

In view of the above, there is proposed another vehicular lamp a2 as shown in FIG. 2.

In the vehicular lamp a2 shown in FIG. 2, a communication hole f2 is formed in the rear wall of a lamp body b2, an upper wall i2 extends backwardly from an upper edge of the communication hole f2, a couple of side walls j2, j2 (only one of which is shown in FIG. 2) respectively extend downwardly from the right and left side edges of the upper wall i2 and have front edges formed continuous with the rear surface of the lamp body b2, and a ventilation passage m2 is formed. The ventilation passage m2 includes an upper edge formed continuous with the near edge of the upper wall i2, right and left side edges respectively communicating with the communication hole f2 due to a rear wall k2 formed continuous with the rear edges of the side walls j2, j2 and extending in the vertical direction, and an open lower end l2.

Due to the above-mentioned structure, a lamp chamber d2 defined by the lamp body b2 and lens communicates with the atmosphere through the communication hole f2 and ventilation passage m2.

Further, there is proposed another conventional vehicular lamp a3 having a ventilation system in which a cylindrical member n3 is provided in the rear wall of a lamp body b3 in such a manner that it projects backwardly, while the interiors of the cylindrical portion n3 are separated into upper and lower portions p3 and q3 by a partition wall o3. An orifice-like communication hole f3 is formed in a portion of the rear wall of the lamp body b3 that is disposed in the front end of the upper portion p3 of the cylindrical member n3.

As shown in FIG. 3, a backwardly facing stepped portion r3 is formed in the portion of the outer peripheral surface of the cylindrical member n3 located near the rear end of such outer peripheral surface.

Further, there is formed an opening s3 at a position near the front end of such wall of the cylindrical portion n3 as defines the lower side of the lower portion q3. An enclosing wall t3 projects downwardly from the lower surface portion of the cylindrical member n3 in such a manner that it encloses an opening s3.

As shown in FIG. 3, a cylindrical cap u3 having a closed rear end is mounted onto the rear end portion of the cylindrical member n3 in such a manner that it is fitted over the rear end portion of the cylindrical member n3. While mounting the cap u3, the front end of the cap u3 contacts to the stepped portion r3 so that the position of which is thereby defined and, in this condition, a closed wall v3 provided in the rear end of the cap is spaced apart backwardly from the rear end of the cylindrical member n3.

Thus, there is formed a ventilation passage in such a way from the communication hole f3→the upper portion p3 of the cylindrical member n3→the space between the rear end of the cylindrical member n3 and the closed wall v3 of the cap u3→ the lower portion q3 of the cylindrical member n3→the opening s3 of the cylindrical member n3, and the lamp chamber d3 communicates with the atmosphere through the ventilation passage.

On the other hand, in solving the above problems, as disclosed in Unexamined Japanese Utility Model Publication No. Sho. 60-84003, there is disclosed such a vehicular lamp a4 as shown in FIG. 4.

In the vehicular lamp a4, a communication hole f4 is formed in the rear wall of a lamp body b4 formed of synthetic resin, while an upper wall i4 extending backwardly from the upper edge of the communication hole f4, tow side walls j4, j4 (only one of them is shown in FIG. 4) respectively extending downwardly from the right and left side edges of the upper wall i4 and including their respective front edges formed continuous with the back surface of the lamp body b4, and a lid member k4 including an upper edge formed continuous with the rear edge of the upper wall i4 cooperate together in defining a ventilation passage m4 which is in communication with the communication hole f4, extends in the vertical direction and includes an open lower end l4.

Here, the lid member k4 is formed integrally with the upper wall i4 through a thin hinge portion n4. The lid member k4, as shown by two-dot chained lines in FIG. 4, is projected backwardly and is then bent substantially at right angles in the hinge portion n4 to be brought into contact with the rear ends of the side walls j4, j4. In this contact state, the lid member k4 and the side walls j4, j4 are welded together to thereby fix the lid member k4 to the side walls j4, j4.

Therefore, a lamp chamber d4, which is defined by the lamp body b4 and a lens, communicates with the atmosphere through the communication hole f4 and ventilation passage m4.

Since the vehicular lamp shown in FIG. 2 does not require a separately produced water preventive pipe as in the vehicular lamp al shown in FIG. 1, the manufacturing cost for the vehicular lamp can be reduced. However, for example, if water splashes into the lamp a2 from the opening formed in the lower end portion of the ventilation passage m2, then the splashing water can move up to the communication hole f2 and thus advance into the lamp chamber d2.

In the vehicular lamp a2, there arises another problem that a slide core is necessary to form the lamp a2.

In the vehicular lamp a4 shown in FIG. 4, since there is eliminated the need for use of a separately produced water preventive pipe h1 as in the vehicular lamp a1 shown in FIG. 1 but the lid member k4 is formed integrally with the lamp body b4, the manufacturing cost for the vehicular lamp can be reduced. However, for example, if water splashes and invades into the lamp a4 from the opening formed in the lower end portion of the ventilation passage m4, then the invading water can move up to the communication hole f4 and thus advance into the lamp chamber d4.

Further, in the vehicular lamp a4 shown in FIG. 4, there is employed a simple structure that the lid member k4 contacts to the side walls j4, j4 to thereby form a space for ventilation and, therefore, unless a good sealing condition is obtained between the lid member k4 and the side walls j4, j4 (the degree of close connection between the lid member k4 and side walls j4, j4 is critical especially when the lid member and side walls are respectively formed of synthetic resin), then water or the like is easy to invade into the lamp chamber d4.

On the other hand, in the vehicular lamp a3 shown in FIG. 3, since the ventilation passage thereof is formed in a maze, the splashed water is prevented from invading into the lamp chamber d3. However, the ventilation passage includes a portion which makes a U-turn with a large radius of curvature to thereby obstruct the smooth flow of the air (that is, a portion extending from the upper portion p3 of the cylindrical portion n3 through the space between the rear end of the cylindrical portion n3 and the closed wall v3 of the cap u3 to the lower portion q3 of the cylindrical portion n3), which makes it difficult for the air to flow. Further, in the vehicular lamp a3, since there is necessary the cap u3 that must be manufactured separately, no cost reduction effect can be expected.

SUMMARY OF THE INVENTION

In view of the above, an object of the present invention is to eliminate the drawbacks accompanying the conventional vehicular lamps as described above.

Accordingly, it is an object of the invention to provide a vehicular lamp having a ventilation system which includes a lamp chamber defined by and between a lens and a lamp body and a communication hole formed in the lamp body in such a manner that it allows the lamp chamber and the outside thereof to communicate with each other, the lamp comprising the following structures (a) to (i):

(a) a inner peripheral wall portion projects from the rear surface of the lamp body in such a manner that it is provided upwardly of as well as on the right and left sides of the communication hole, while a pair of upper and lower water preventive walls projecting downwardly of the communication hole is included in part of the first peripheral wall portion;

(b) a outer peripheral wall portion enclosing the first peripheral wall portion is provided on and projecting from the rear surface of the lamp body, and a lid member so provided as to cover the projecting end side of the first peripheral wall portion is formed integrally with the second peripheral wall portion;

(c) the lid member contacts to the first peripheral wall portion to thereby define a first space between the lamp body, lid member and first peripheral wall portion, and the first space communicates through the communication hole with the lamp chamber;

(d) the lid member contacts to the first peripheral wall portion to thereby define a second space between the lamp body, lid member and upper and lower water preventive walls;

(e) the lid member contacts to the first and second peripheral wall portions to define a third space between the lamp body, lid member, the lower water preventive wall and the second peripheral wall portion;

(f) the lid member is contacted with the second peripheral wall portion to thereby define a fourth space between the lamp body, lid member, first peripheral wall portion, and second peripheral second wall portion;

(g) the first space communicates with the second space through a first communication passage formed in the portion of the first peripheral wall portion located near the bottom of the first peripheral wall portion;

(h) the second space communicates with the third space through a second communication passage formed in the portion of the first peripheral wall portion located opposite to the first communication passage; and (i) the third space merges with the fourth space and communicate with the atmosphere through a second communication passage which is formed in the portion of the second peripheral portion located near the bottom thereof and also which is formed at a position not opposed to the opening of the first communication passage.

Therefore, according to the vehicular lamp of the invention, the lid member is formed integrally with the second peripheral wall portion, there is eliminated the need for provision of a separate member such as a water preventive pipe. Further, since there is formed the ventilation passage having a triple structure consisting of a first space formed between the lamp body, a second space formed between the upper and lower water preventive walls, a first peripheral wall portion and lid member, and a third space formed between the lamp body, the first communication passage for communicating the first space and the second space is disposed at opposite side in lateral direction to the second communication passage for communicating the second space and the third space. Therefore, the water coming from the outside is difficult to invade into the first space through the second space.

DESCRIPTION OF THE PREFERRED EMBODIMENTS

Figure 1:
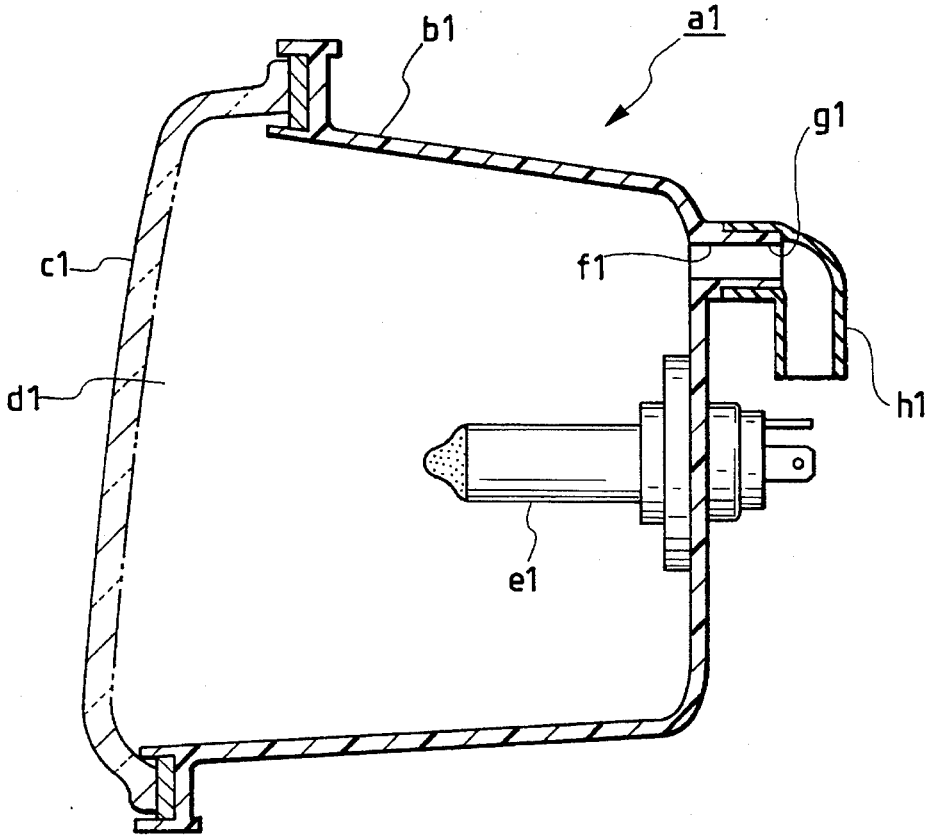
FIG. 1 is a section view of the main portions of a first conventional vehicular lamp.
Figure 2:
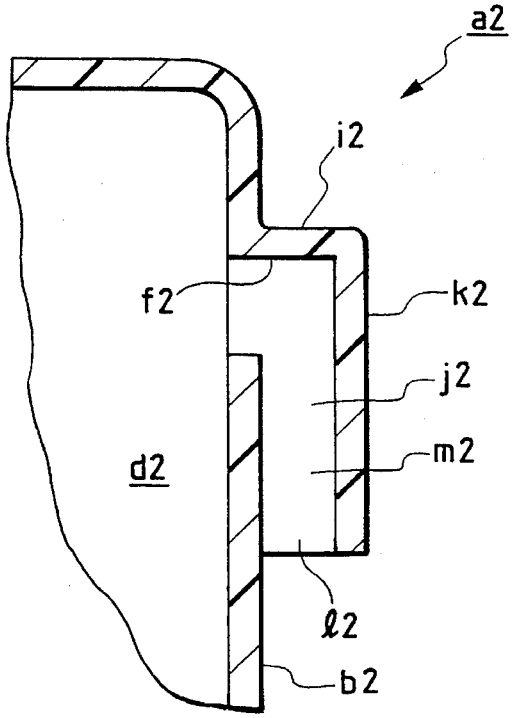
FIG. 2 is a section view of the main portions of a second conventional lamp.
Figure 3:
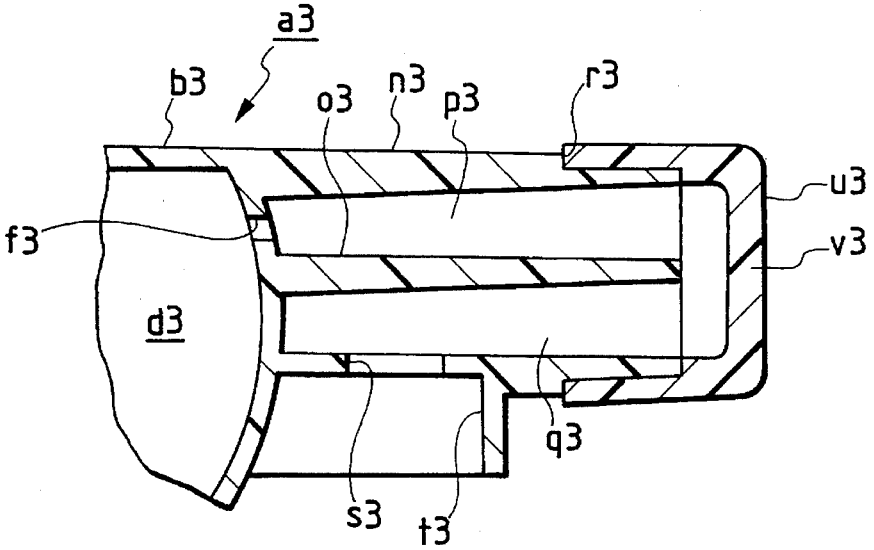
FIG. 3 is a section view of the main portions of a third conventional lamp.
Figure 4:
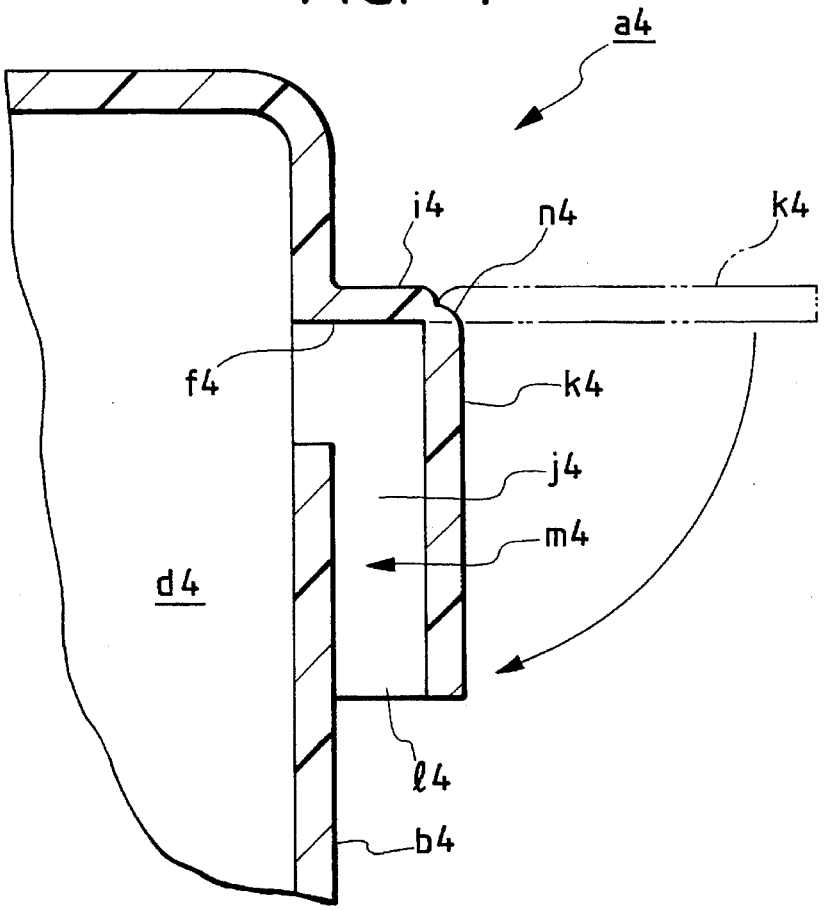
FIG. 4 is a section view of the main portions of a fourth conventional lamp.
Figure 5:
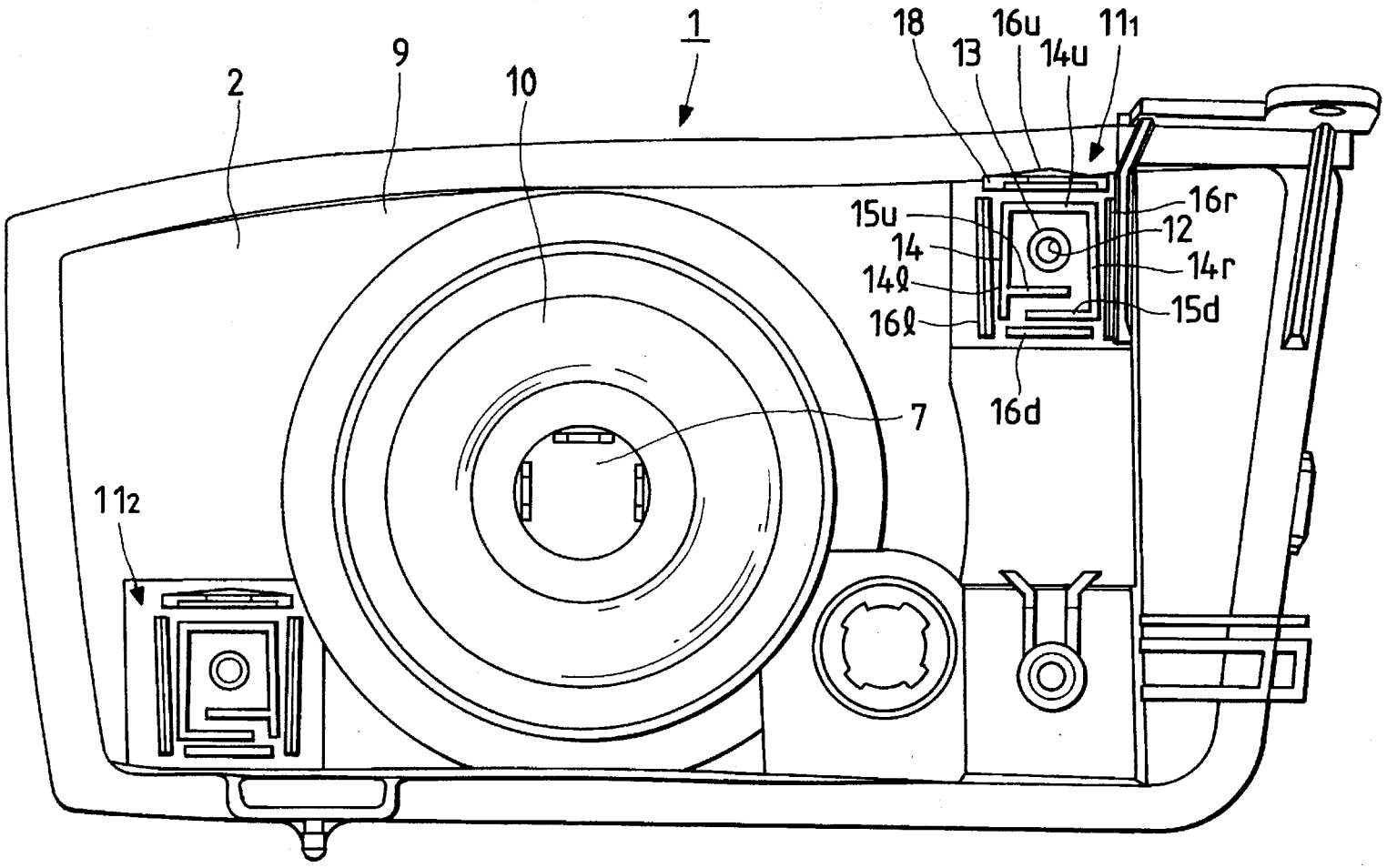
FIG. 5 is a general back view of a first embodiment of a vehicular lamp, showing a state thereof in which a lid member is opened.
Figure 6:
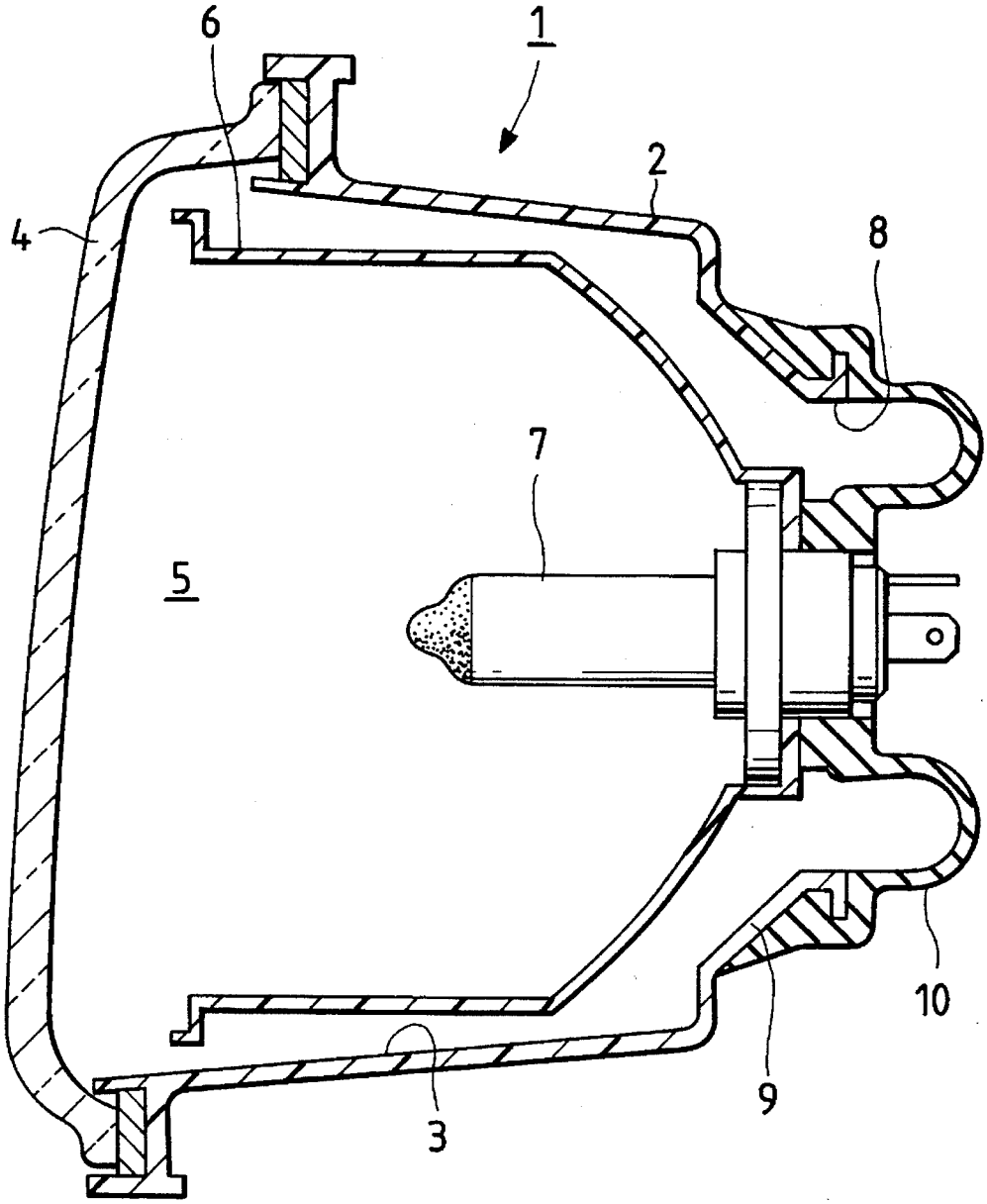
FIG. 6 is a section taken along the line VI—VI shown in FIG. 5.
Figure 7:
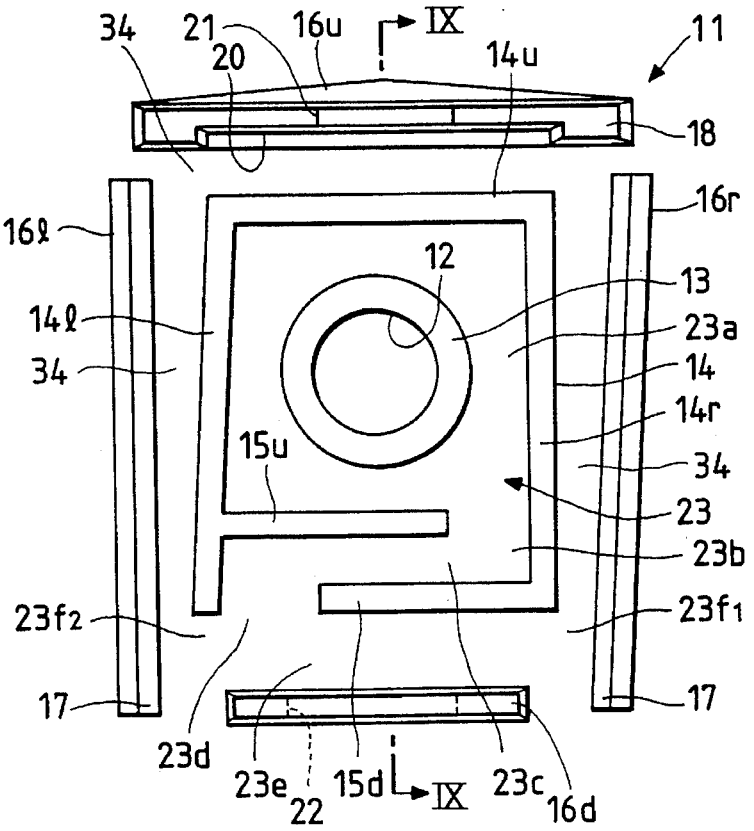
FIG. 7 is an enlarged back view of the main portions of the first embodiment, showing a state thereof in which a lid member is opened.
Figure 8:
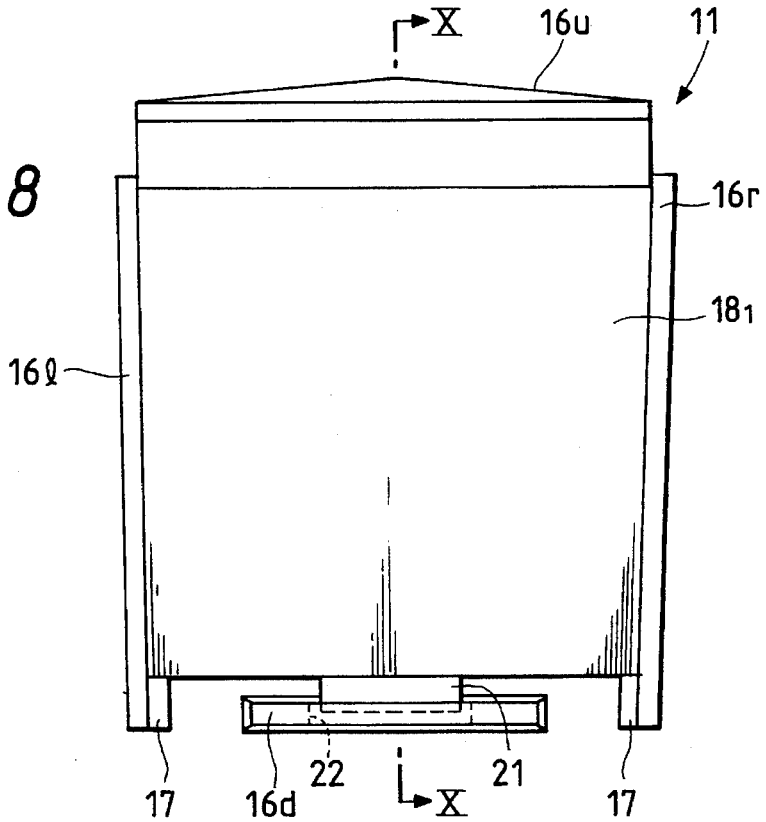
FIG. 8 is an enlarged back view of the main portions of the first embodiment, showing a state thereof in which a lid member is closed.
Figure 9:
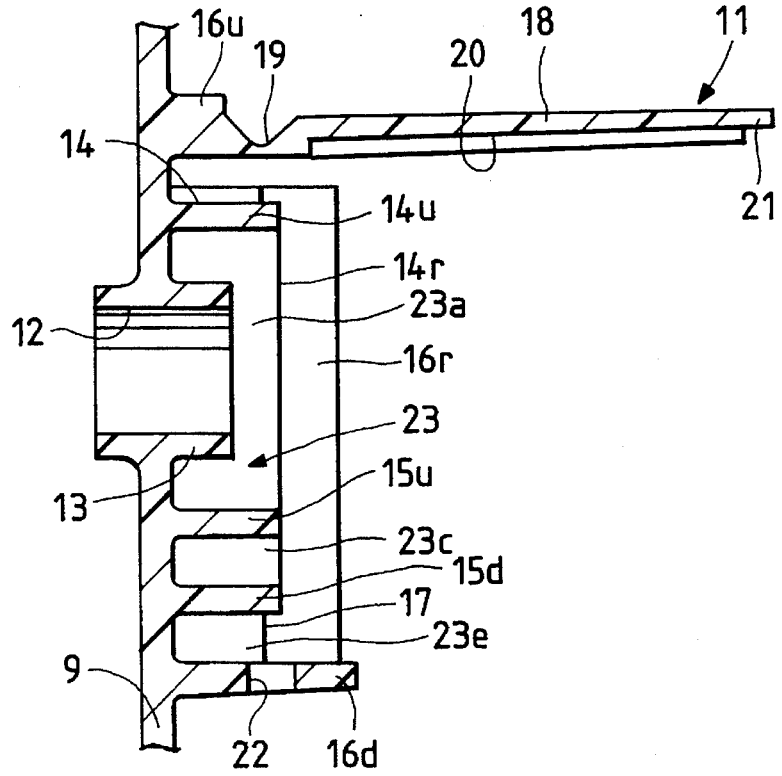
FIG. 9 is a section taken along the line IX—IX shown in FIG. 7.
Figure 10:
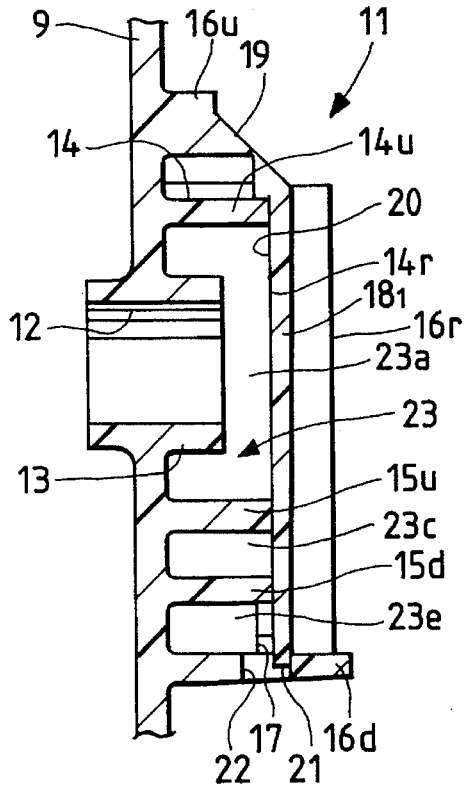
FIG. 10 is a section taken along the line X—X shown in FIG. 8.

Now, description will be given below in detail of the respective embodiments of a vehicular lamp according to the invention with reference to the accompanying drawings.

At first, FIGS. 5 to 10 shows a first embodiment of a vehicular lamp according to the invention. In the first embodiment, the invention is applied to a headlamp in a vehicle.

In these figures, a lamp body 2 is formed of synthetic resin and includes a recessed portion 3 opened forwardly. A lens 4 is mounted on the lamp body 2 in such a manner that it can cover the opening of the lamp body 2. The lens 4 and lamp body 2 cooperate together in defining a lamp chamber 5 which is closed substantially tightly.

A reflector 6 is disposed within the lamp chamber 5 and is inclinably supported on the lamp body 2 by means of a support mechanism (not shown). A lamp 7 is replaceably supported by the reflector 6. 8 represents an opening which is formed in the rear wall 9 of the lamp body 2 at a position corresponding to the lamp 7. The opening 8 is used to replace the lamp 7 with a new one and is, normally, closed with a cover member 10 which is removably mounted.

Ventilation portions $\mathbf{11}_1$ and $\mathbf{11}_2$ are respectively formed in the upper right and lower left portions of the lamp body 2 when viewed from behind the rear wall 9 of the lamp body 2. The respective components of the two ventilation systems $\mathbf{11}_1$ and $\mathbf{11}_2$ are similar to each other, except that the positions thereof are symmetric. Therefore, description will be given mainly of the ventilation system $\mathbf{11}_1$ provided in the upper right and thus the description of the ventilation system $\mathbf{11}_2$ provided in the lower left is almost omitted here.

A communication hole 12 is formed in the rear wall 9 in a circular shape. And, a cylindrical portion 13 is formed integrally with the communication hole 12 and extends backwardly from the opening edge of the communication hole 12.

An inner peripheral wall 14 is provided integrally with and projected backwardly from the rear surface of the rear wall 9. The peripheral wall 14 includes an upper peripheral wall **14*u*, a right peripheral wall 14*r*, and a left peripheral wall 14*l* which are formed integrally with one another. In particular, the upper peripheral wall 14*u* is positioned upwardly of the cylindrical portion 13, the right peripheral wall 14*r* extends downwardly from the right end of the upper peripheral wall 14*u*, and the left peripheral wall 14*l* extends downwardly from the left end of the upper peripheral wall 14*u***.

The right peripheral wall **14*r* is inclined such that it is slightly shifted to the right as it goes downwardly, while the left peripheral wall 14*l*** is inclined such that it is slightly shifted to the left as it goes downwardly.

An upper and lower water preventive walls 15*u* and 15*d* which are respectively formed integrally with and project backwardly from the rear surface of the rear wall 9. The upper water preventive wall 15*u* extends to the right from a position slightly above the lower end of the left peripheral wall 14*l* and terminates in front of the right peripheral wall 14*r*. The lower water preventive wall 15*d* extends to the left from the lower end of the right peripheral wall 14*r* and terminates in front of the lower end of the left peripheral wall 14*l*.

The respective amounts of projection of the peripheral wall 14 as well as the upper and lower water preventive walls 15*u* and 15*d* from the rear surface of the rear wall 9 are set almost equal to one another, whereas the amount of projection of the cylindrical portion 13 from the rear surface of the rear wall 9 is set smaller than the amounts of projection of the peripheral wall 14 as well as the water preventive walls 15*u* and 15*d*.

An upper outer peripheral wall 16*u*, a right outer peripheral wall 16*r*, a left outer peripheral wall 16*l* and a lower outer peripheral wall 16*d* are respectively provided on and projected backwardly from the rear surface of the rear wall 9. In particular, the upper outer peripheral wall 16*u* is provided upwardly of the upper peripheral wall 14*u*, the right outer peripheral wall 16*r* is disposed on the right of the right peripheral wall 14*r*, the left outer peripheral wall 16*l* is provided on the left of the left peripheral wall 14*l*, and the lower outer peripheral wall 16*d* is provided downwardly of the lower water preventive wall 15*d*.

The amounts of projection of the outer peripheral walls 16*r*, 16*l* and 16*d* except for the upper peripheral wall 16*u* from the rear surface of the rear wall 9 are larger than those of the peripheral wall 14 as well as the water preventive walls 15*u* and 15*d*.

The right outer peripheral wall 16*r* is inclined such that it is shifted slightly to the right as it goes upwardly, while the left outer peripheral wall 16*l* is inclined such that it is shifted slightly to the left as it goes downwardly. On the mutually opposing surfaces of the outer peripheral walls 16*r* and 16*l*, there are provided stepped portions 17 and 17 which respectively face backwardly. And, the stepped portions 17 and 17 are provided slightly in front of the rear ends of the peripheral wall 14 as well as the water preventive walls 15*u* and 15*d*.

A lid member $\mathbf{18}_1$ is formed integrally and continuously with the rear end edge of the upper outer peripheral wall 16*u* through an integral hinge 19 so formed as to have a small thickness. The lid member $\mathbf{18}_1$ is formed in a plate which is one size larger than the area that is enclosed by the peripheral wall 14 and which includes, in the surface thereof opposed to the rear wall 9, a large and shallow recessed portion 20. The recessed portion 20 is formed in a size which allows the rear end portion of the peripheral wall 14 to be stored therein completely.

The lid member $\mathbf{18}_1$ includes an engaging piece 21 in the leading end portion thereof, that is, the engaging piece 21 is disposed in the central portion of the right and left direction of the end of the lid member $\mathbf{18}_1$ opposite to the end thereof connected to the upper outer peripheral wall 16*u* by the hinge 19.

At a position provided near the rear end of the lower outer peripheral wall 16*d*, there is formed an engaging hole 22 consisting of an elongated hole which extends in the right and left direction of the lid member $\mathbf{18}_1$.

The lid member $\mathbf{18}_1$ is bent in the portion of the hinge 19 and is thus so positioned as to cover the peripheral wall 14 as well as the water preventive walls 15*u* and 15*d*, while the engaging piece 21 engaged with the engaging hole 22 of the lower outer peripheral wall 16*d*, whereby the lid member $\mathbf{18}_1$ is maintained in such a state in which it covers the rear side of the peripheral wall 14 as well as the rear sides of the water preventive walls 15*u* and 15*d*. In this state, the rear end portions of the peripheral wall 14 as well as the water preventive walls 15*u* and 15*d* are provided within the recessed portion 20 of the lid member $\mathbf{18}_1$, while the right and left edges of the lid member $\mathbf{18}_1$ are in contact with the stepped portions 17 and 17 of the right and left outer peripheral walls 16*r* and 16*l*.

Thus, between the lamp chamber 5 and lamp body 2, there is formed a maze of ventilation passage 23 in a portion which is enclosed by the communication hole 12, cylindrical portion 13, the rear surface of the rear wall 9, the peripheral wall 14, the upper and lower water preventive walls 15*u* and 15*d*, the lower outer peripheral wall 16*d*, and the lid member $\mathbf{18}_1$.

The ventilation passage 23 is constituted by a by a first space 23*a* which is defined by the rear wall 9, the peripheral wall 14, the outer peripheral surface of the cylindrical portion 13, the upper water preventive wall 15*u*, and the lid member $\mathbf{18}_1$, a second space 23*c* defined by the rear wall 9, the upper and lower water preventive walls 15*u* and 15*d*, the lower end portions of the right and left peripheral walls 14*r* and 14*l*, and the lid member $\mathbf{18}_1$, and a third space 23*e* defined by the rear wall 9, the lower water preventive wall 15*d*, the lower outer peripheral wall 16*d*, and lid member $\mathbf{18}_1$. The first space 23*a* communicates with the second space 23*c* through a first communication passage 23*b* formed in the portion of the first peripheral wall portion located near the bottom of the first peripheral wall portion. The second space 23*c* communicates with the third space 23*e* through a second communication passage 23*d* formed in the portion of the first peripheral wall portion located opposite to the first communication passage 23*b*.

Additionally, fourth spaces 34 are defined between the lamp body, lid member, first peripheral wall portion, and second peripheral second wall portion. The fourth spaces 34 merge with the third space 23*e* and communicate with the atmosphere through the third communication passages $\mathbf{23}f_1$ and $\mathbf{23}f_2$ which are formed in the portion of the second peripheral portion located near the bottom thereof.

That is, the ventilation passage 23 is formed in the following manner: the communication hole 12→the cylindrical portion 13→a first space 23*a* which is defined by the rear wall 9, the peripheral wall 14, the outer peripheral surface of the cylindrical portion 13, the upper water preventive wall 15*u*, and the lid member $\mathbf{18}_1$→a first communication passage 23*b* enclosed by the rear wall 9, the leading end edge of the upper water preventive wall 15*u*, the portion of the right peripheral wall 14*r* opposed to the leading end edge of the wall 15*u*, and the lid member $\mathbf{18}_1$→a second space 23*c* defined by the rear wall 9, the upper and lower water preventive walls 15*u* and 15*d*, the lower end portions of the right and left peripheral walls 14*r* and 14*l*, and the lid member $\mathbf{18}_1$→a second communication passage 23*d* enclosed by the rear wall 9, the leading end edge of the lower water preventive wall 15*d*, the portion of the left peripheral wall 14*l* opposed to the leading end edge of the wall 15*d*, and the lid member $\mathbf{18}_1$→a third space 23*e* defined by the rear wall 9, the lower water preventive wall 15*d*, the lower outer peripheral wall 16*d*, and lid member $\mathbf{18}_1$→the third communication passages $\mathbf{23}f_1$, $\mathbf{23}f_2$ respectively defined by the rear wall 9, the respective lower end edges of the right and left peripheral walls 14*r* and 14*l*, the right and left end edges of the lower outer peripheral wall 16*d*, and the lid member $\mathbf{18}_1$. In addition, the fourth spaces 34 are defined by the inner peripheral wall 14, outer peripheral wall 16 and lid member $\mathbf{18}_1$ which communicate with the third space in the vicinity of the edge portions of the lower outer peripheral wall 16*d*.

The passages 23*b* and 23*d* are formed such that the sectional areas thereof are substantially equal to the sectional area of the communication hole 12.

Accordingly, in the above-mentioned headlamp 1 for a vehicle, since the maze-like ventilation 23 allows the lamp chamber 5 to communicate with the atmosphere and thus air can flow into the lamp chamber 5 from the outside and the air can flow out through the lamp chamber 5 to the outside, even if the lens 4, reflector 6 and the like get fogged, such fogging can be removed quickly. Especially, in the vehicle headlamp 1, since one ventilation system $\mathbf{11}_1$ is provided in the upper right and the other ventilation system $\mathbf{11}_2$ is provided in the lower left, the air flows uniformly within the lamp chamber 5 in the course of the ventilation system $\mathbf{11}_2$→the lamp chamber 5→the ventilation system $\mathbf{11}_1$.

Since the sectional areas of the first and second communication passages 23*b* and 23*d* providing a narrow path in the ventilation passage 23 are set substantially equal to the sectional area of the communication hole 12, an amount of air flow corresponding to the amount of air flow in the communication hole 12 can be secured and thus a sufficient amount of air can be flown into the lamp chamber 5.

Further, since all components of the ventilation systems $\mathbf{11}_1$ and $\mathbf{11}_2$ are formed integrally with the lamp body 2, the cost of the headlamp 1 can be reduced. The reason why the right and left peripheral walls 14*r*, 14*l* and the right and left outer peripheral walls 16*r*, 16*l* are inclined in the opposite directions to each other is to make it possible to remove a metal mold which is used to form the recessed portion 20 of the lid member $\mathbf{18}_1$.

Still further, even if water such as splash during the running operation of the vehicle pelts on the ventilation systems $\mathbf{11}_1$ and $\mathbf{11}_2$, such water can be blocked by the outer peripheral wall, especially, by the lower outer peripheral wall 16*d*. And, even if water happens to invade into the ventilation passage 23, the water will be prevented by the upper water preventive wall 15*u* and cylindrical portion 13 so that no water can enter the interior of the lamp chamber 5.

While most of water such as splash or the like comes from laterally of the vehicular lamp, in the ventilation systems $\mathbf{11}_1$ and $\mathbf{11}_2$, since the opening of the portion 23*d* consisting of the peripheral wall 14 and upper and lower water preventive walls 15*u*, 15*d* of the ventilation passage 23 faces toward the central side of the vehicular lamp, which makes it difficult for the water to enter the vehicular lamp.

Figure 11:
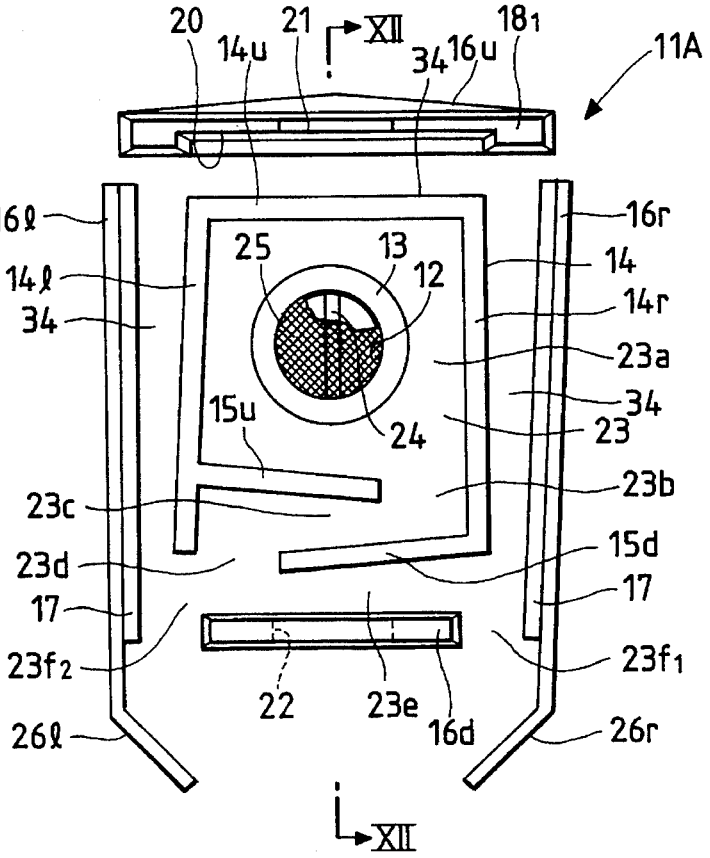
FIG. 11 is an enlarged back view of the main portions of a second embodiment of a vehicular lamp according to the invention, showing a state thereof in which a lid member is opened.
Figure 12:
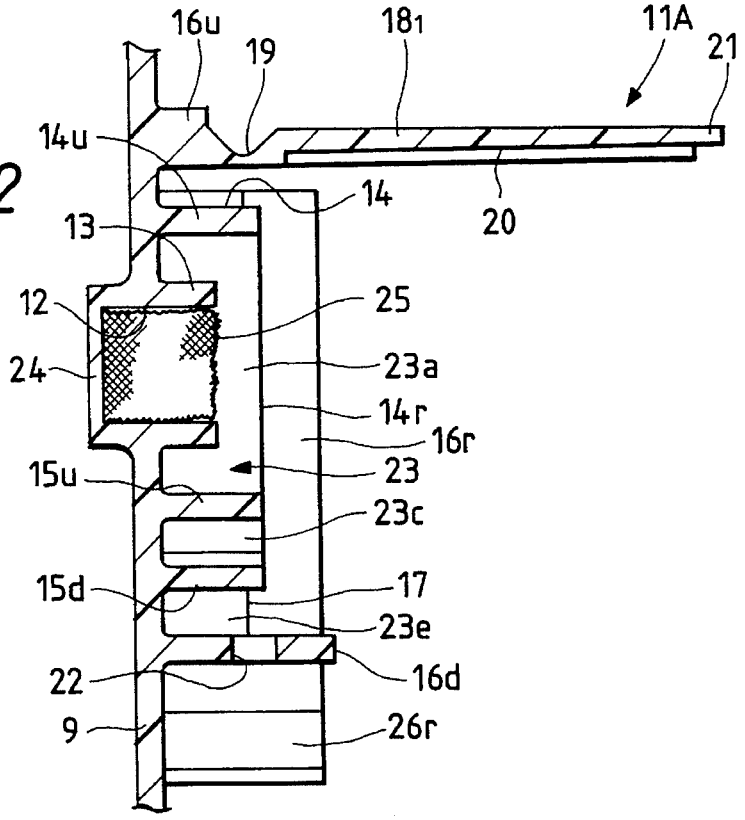
FIG. 12 is a section view taken along the line XII—XII shown in FIG. 11.
Figure 13:
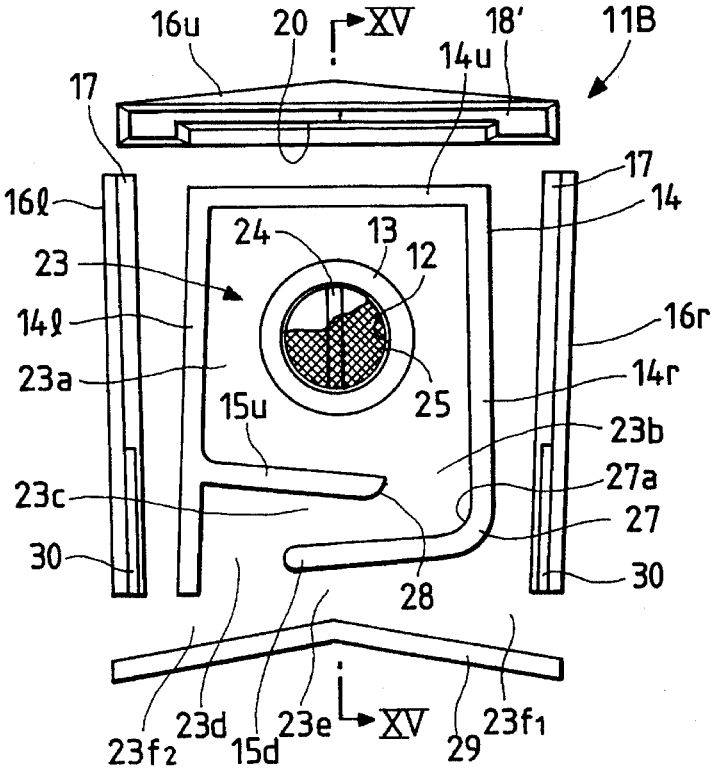
FIG. 13 is an enlarged back view of the main portions of a third embodiment of a vehicular lamp according to the invention, showing a state thereof in which a lid member is opened.
Figure 14:
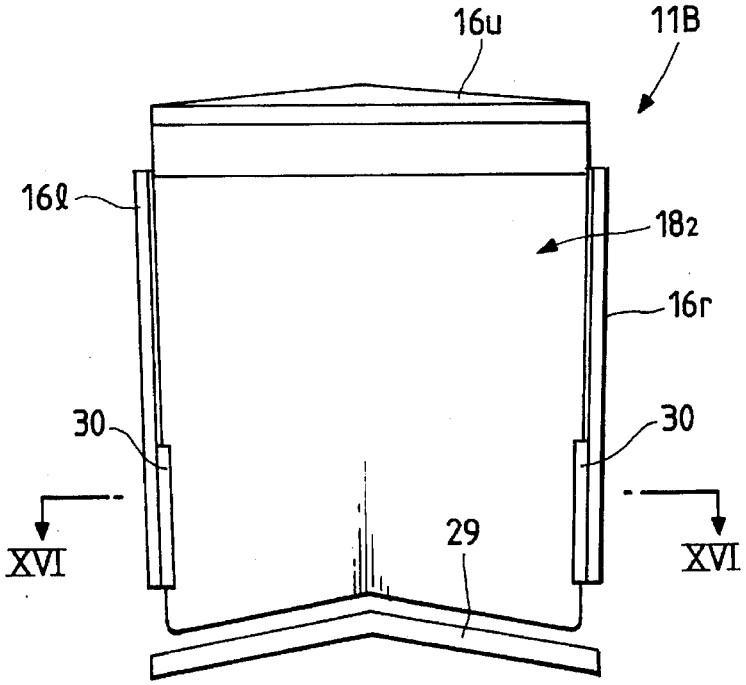
FIG. 14 is an enlarged back view of the main portions of the third embodiment, showing a state thereof in which a lid member is closed.
Figure 15:
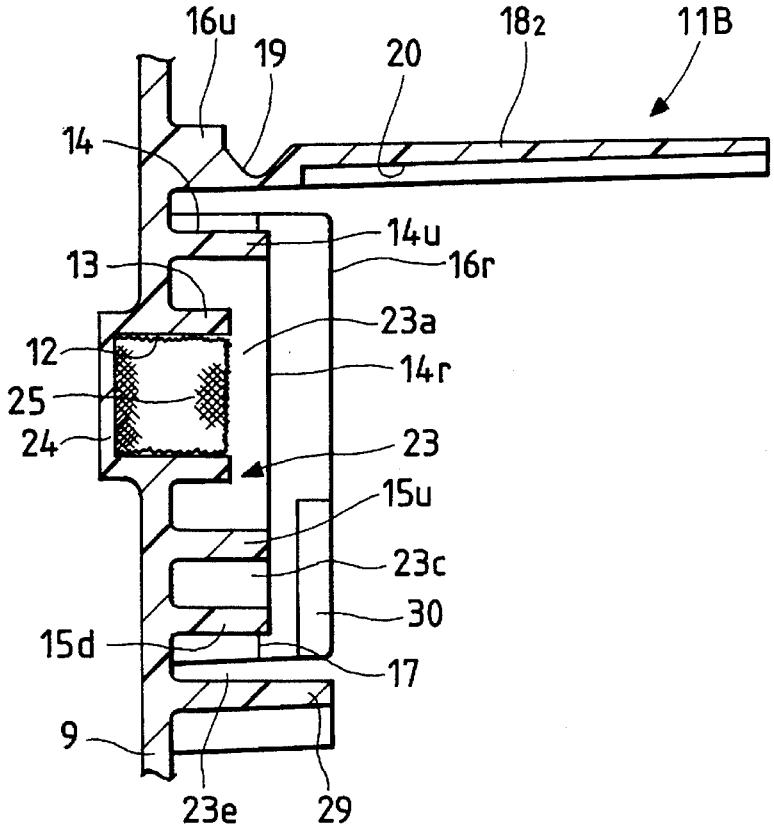
FIG. 15 is a section view taken along the line XV—XV shown in FIG. 13.
Figure 16:
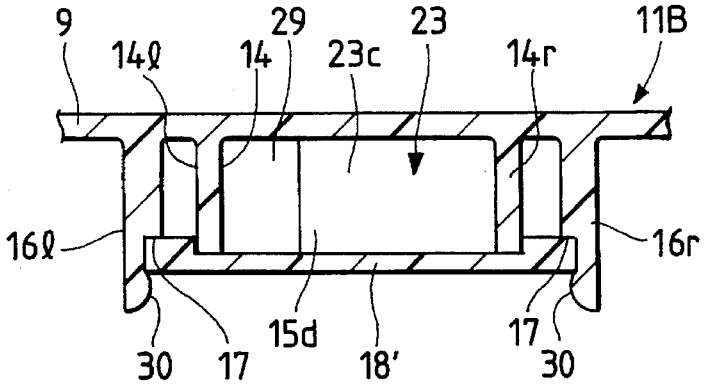
FIG. 16 is a section view taken along the line XVI—XVI shown in FIG. 14.

FIGS. 11 and 12 show a second embodiment of a vehicular lamp according to the invention, in which only the ventilation system thereof is different from that of the first embodiment and thus only the ventilation system 11A is shown.

Since the ventilation system 11A is almost similar to the above-mentioned ventilation system $\mathbf{11}_1$, the similar portions of the ventilation system 11A to the ventilation $\mathbf{11}_1$ are given the same designations and the description thereof is omitted here.

A stopper 24 is formed in such a manner that it crosses the center of the communication hole 12 in the vertical direction.

A filter 25 is provided in such a manner that it is fitted within the cylindrical portion 13. The front end of the filter 25 is in contact with the stopper 24, whereby the position of the filter 25 is regulated.

The upper and lower water preventive walls 15*u* and 15*d* are inclined respectively. That is, the upper water preventive wall 15*u* is inclined to the right, while the lower water preventive wall 15*d* is inclined to the left. And, the angle of inclination of the respective upper and lower water preventive walls are set as about 5° with respect to the horizontal surface.

Further, the right and left outer peripheral walls 16*r* and 16*l* respectively include extension portions 26*r* and 26*l* which extend downwardly from the walls. The extension portions 26*r* and 26*l* are respectively shaped dog-legged when they are viewed from behind. In detail, the extension portion 26*r* of the right outer peripheral wall 16*r* is bent in such a manner that it shifts to the left as the lower half section thereof goes downward, while the extension portion 26*l* of the left outer peripheral wall 16*l* is bent in such a manner that it shifts to the right as the lower half section thereof goes downward.

However, in the second embodiment, since the filter 25 is loaded in the cylindrical portion 13, dust or the like is prevented from invading into the lamp chamber 5 as the air flows.

The right and left outer peripheral walls 16*r* and 16*l* respectively include extension portions 26*r* and 26*l* and the lower half sections of the extension portions 26*r* and 26*l* are positioned in such a manner that they embrace the lower right and left side portions of the lower outer peripheral wall 16*d*, which can prevent the invasion of water effectively.

Further, even if water happens to invade into the ventilation passage 23, because the water preventive walls 15*u* and 15*d* are inclined, the water that has invaded into the ventilation passage 23 will be discharged quickly therefrom.

FIGS. 13 to 16 show a third embodiment of a vehicular lamp according to the invention, in which only the ventilation system thereof is different from the ventilation system of the second embodiment and thus only the ventilation system 11B is shown.

While the ventilation system 11B is almost similar to the ventilation system 11A, the similar components of the ventilation system 11B to those of the ventilation system 11A are given the same designations and thus the description thereof is omitted here.

In the ventilation system 11B, a connecting portion 27 for connection with the right peripheral wall 14*r* of the lower water preventive wall 15*d* is formed in an almost quarter arc and, therefore, the inner surface 27*a* of the connecting portion 27 is formed in a recessed curved surface, while the portion 28 of the leading end face of the upper water preventive wall 15*u* opposed to the recessed curved surface 27*a* is also formed in a projected curved surface.

The lower outer peripheral wall 29 is formed in a bent shape which is turned down at the corners thereof with a gentle bent angle.

Further, on the inner surfaces of the lower end portions of the right and left outer peripheral walls 16*r* and 16*l*, that is, on the mutually opposing surfaces thereof, there are formed semicylindrical securing projection strips 30 and 30 which are disposed at positions near the respective ends of the walls 16*r* and 16*l* in such a manner that they extend in the vertical direction.

The engaging piece 21 is not formed in the lid member $\mathbf{18}_2$. Accordingly, the lid member $\mathbf{18}_2$ is bent in the portion of the hinge 19 and is thus positioned such that it covers the peripheral wall 14 as well as the upper and lower water preventive walls 15*u* and 15*d*. During this operation, while the two side edge portions of the leading end portion of the lid member $\mathbf{18}_2$ flex the rear portions of the lower end portions of the right and left outer peripheral walls 16*r* and 16*l*, the two side edge portions pass to the front sides of the securing projection strips 30 and 30. When the leading end portion of the lid member $\mathbf{18}_2$ get into contact with the stepped portions 17 and 17 of the outer peripheral walls 16*r* and 16*l*, the outwardly flexed lower end portions of the outer peripheral walls 16*r* and 16*l* are returned back to their original states, and the securing projection strips 30 and 30 are positioned in the rear of the leading end portion of the lid member $\mathbf{18}_2$, thereby maintaining the lid member $\mathbf{18}_2$ in such a state in which it covers the respective rear sides of the peripheral wall 14 as well as the water preventive walls. 15*u* and 15*d*.

If the inside of the connecting portion between the lower water preventive wall 15*d* and right peripheral wall 14*r* in the ventilation passage 23 is formed in a corner shape, then, in this corner portion, there is generated an eddy current in the air flow and thus the air flow is obstructed by such eddy current and, at the same time, water is easy to remain in the corner portion due to the surface tension. On the other hand, in the present ventilation system 11B, the inner surface 27*a* of the connecting portion 27 for connecting the lower water preventive wall 15*d* with the right peripheral wall 14*r* is formed in a recessed curved surface and also the portion 28 of the leading end face of the upper water preventive wall 15*u* opposed to the recessed curved surface 27*a* is also formed in a projected curved surface. This prevents an eddy current from being generated in the air flow in this area, so that the air can flow smoothly through the ventilation passage 23. Also, there is eliminated the possibility that water can remain in the inner surface 27*a* of the connecting portion 27.

Further, since the lower outer peripheral wall 29 is turned down at the corners, even the water that has arrived at the upper surface of the lower outer peripheral wall 29 can be discharged quickly.

Figure 17:
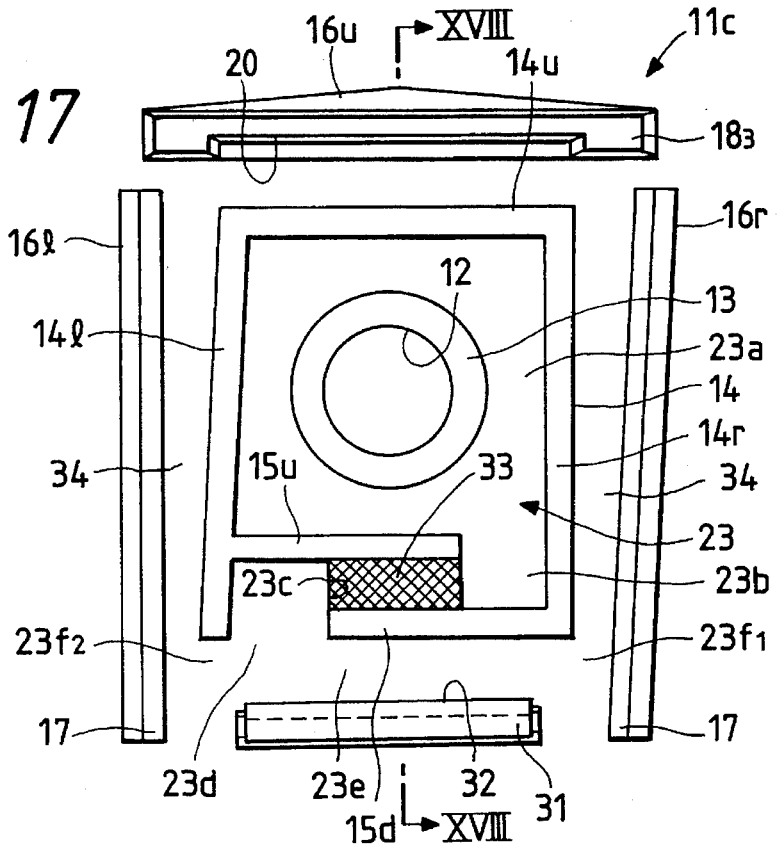
FIG. 17 is an enlarged back view of the main portions of a fourth embodiment of a vehicular lamp according to the invention, showing a state thereof in which a lid member is opened.
Figure 18:
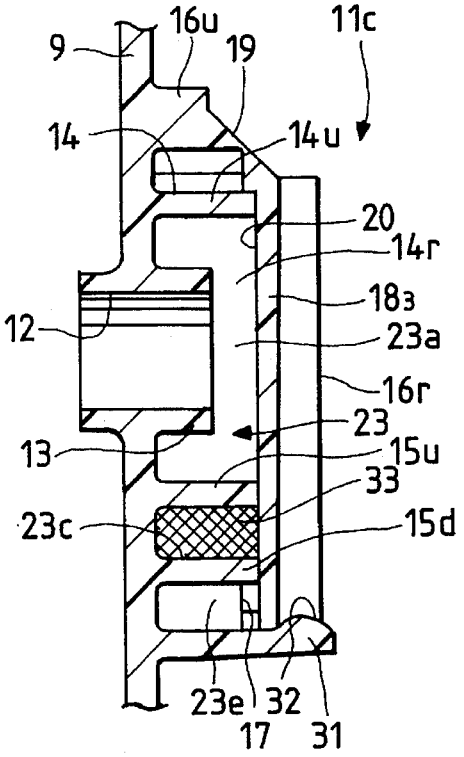
FIG. 18 is a section view taken along the line XIII—XIII shown in FIG. 17, showing a state of the fourth embodiment in which a lid member is closed.

FIGS. 17 and 18 show a fourth embodiment of a vehicular lamp according to the invention, in which only the ventilation system thereof is different from the respective ventilation systems of the previous embodiments and thus only the ventilation system 11C is shown.

The lid member $\mathbf{18}_3$ of the fourth embodiment does not include the engaging piece 21 at the leading end thereof.

A lower outer peripheral wall 31 includes an engaging projection strip 32 on the leading end edge of the upper surface thereof.

A filter 33 is loaded into and disposed in a portion between the upper and lower water preventive walls 15*u* and 15*d*, that is, in the second space 23*c* of the ventilation passage 23.

The lid member $\mathbf{18}_3$ is positioned in such a manner that it covers the respective walls 14, 15, 16 and 31, and the two side edge portions of the lid member $\mathbf{18}_3$ are placed on the stepped portions 17 and 17 of the right and left outer peripheral walls 16*r* and 16*l*. Also, the leading end portion of the lid member $\mathbf{18}_3$, while flexing the lower outer peripheral wall 31 downwardly, moves to the front side of the engaging projection strip 32 to bring the engaging projection strip 32 into engagement with the rear side of the leading end portion of the lid member $\mathbf{18}_3$, thereby maintaining the lid member $\mathbf{18}_3$ in a closed state.

Accordingly, in the ventilation system 11C according to the present embodiment, since the filter 33 is positioned in part of the ventilation passage 23, dust is prevented from invading into the lamp chamber.

In the above-mentioned respective embodiments, fourth spaces 34, which are defined by the right and left outer peripheral walls 16*r*, 16*l* of the right and left peripheral walls 14*r*, 14*l* and the lid member $\mathbf{18}_1$, $\mathbf{18}_2$, $\mathbf{18}_3$, are opened at the lower ends thereof. In this structure, since the side edge portions of the lid member $\mathbf{18}_1$, $\mathbf{18}_2$, $\mathbf{18}_3$ are only in contact with the outer peripheral walls 16*l*, 16*r*, there is a danger that water can invade from this. However, even if water happens to invade, since the fourth spaces 34 are opened at the lower ends thereof, the invaded water can be discharged quickly.

FIGS. 19 to 26 show a fifth embodiment of a vehicular lamp according to the invention. In the present embodiment 101, the invention is applied to a headlamp.

Figure 20:
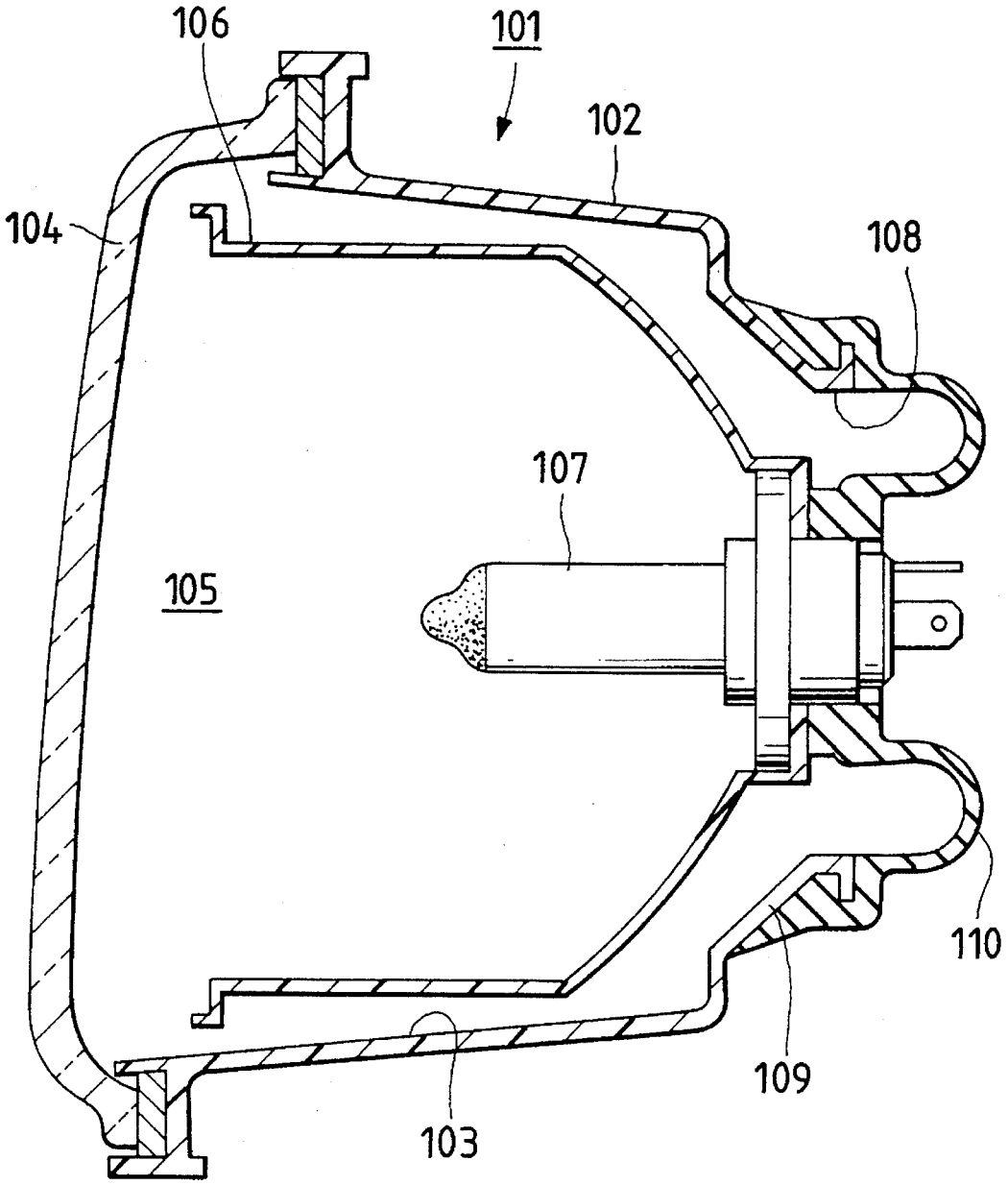
FIG. 20 is a section view taken along the line XX—XX shown in FIG. 19.
Figure 21:
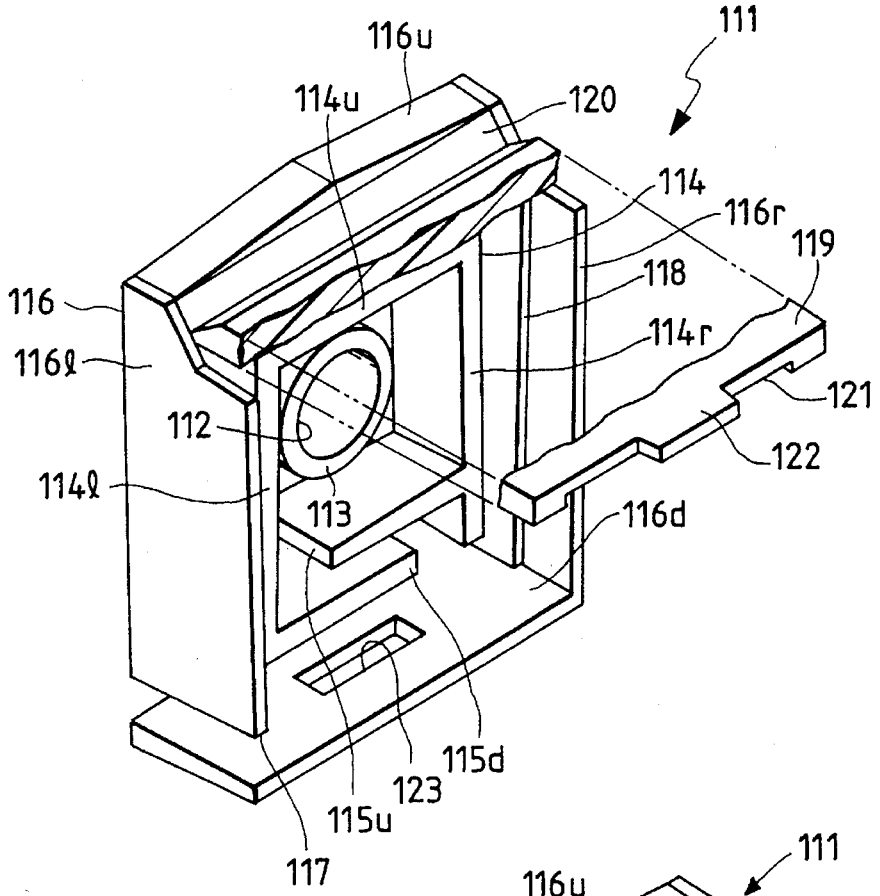
FIG. 21 is a perspective view of the main portions of the fifth embodiment, showing a state thereof in which a lid member is opened and is in part cut away.
Figure 22:
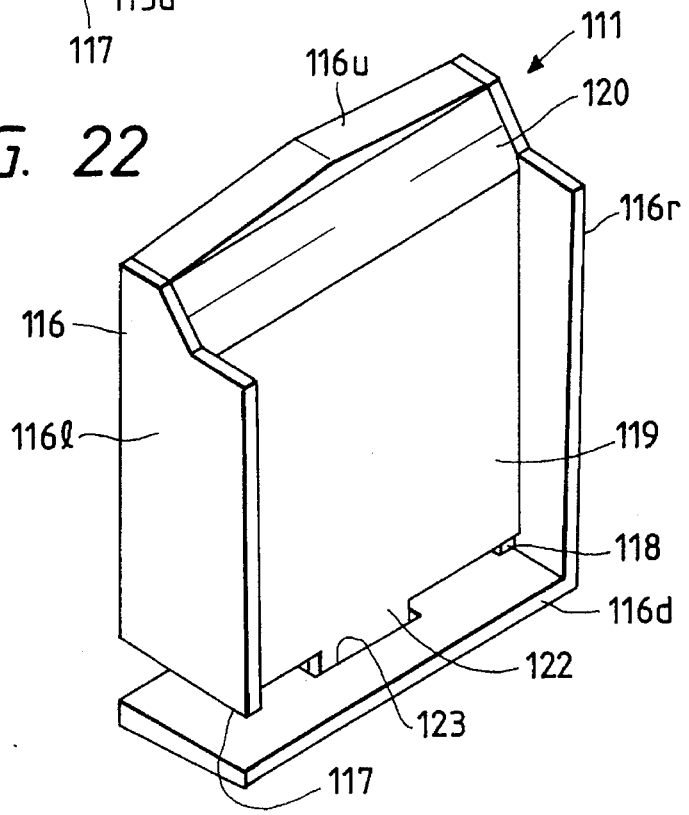
FIG. 22 is a perspective view of the main portions of the fifth embodiment, showing a state thereof in which a lid member is closed.

A lamp body 102 is formed of synthetic resin and includes a forwardly opened recessed portion 103 (see FIG. 20).

A lens 104 is mounted on the lamp body 102 in such a manner that it covers the opening of the lamp body 102. The lens 104 and lamp body 102 cooperate in forming a substantially tightly closed lamp chamber 105.

A reflector 106 is disposed within the lamp chamber 105 and is inclinably supported on the lamp body 102 by a support mechanism (not shown). A light bulb 107 is replaceably supported by the reflector 106. 108 represents an opening portion formed in the rear wall 109 of the lamp body 102 at a position corresponding to the light bulb 107. The opening portion 108 is used to replace the light bulb 107 and is normally closed by a cover member 110 which can be freely mounted and removed.

Figure 19:
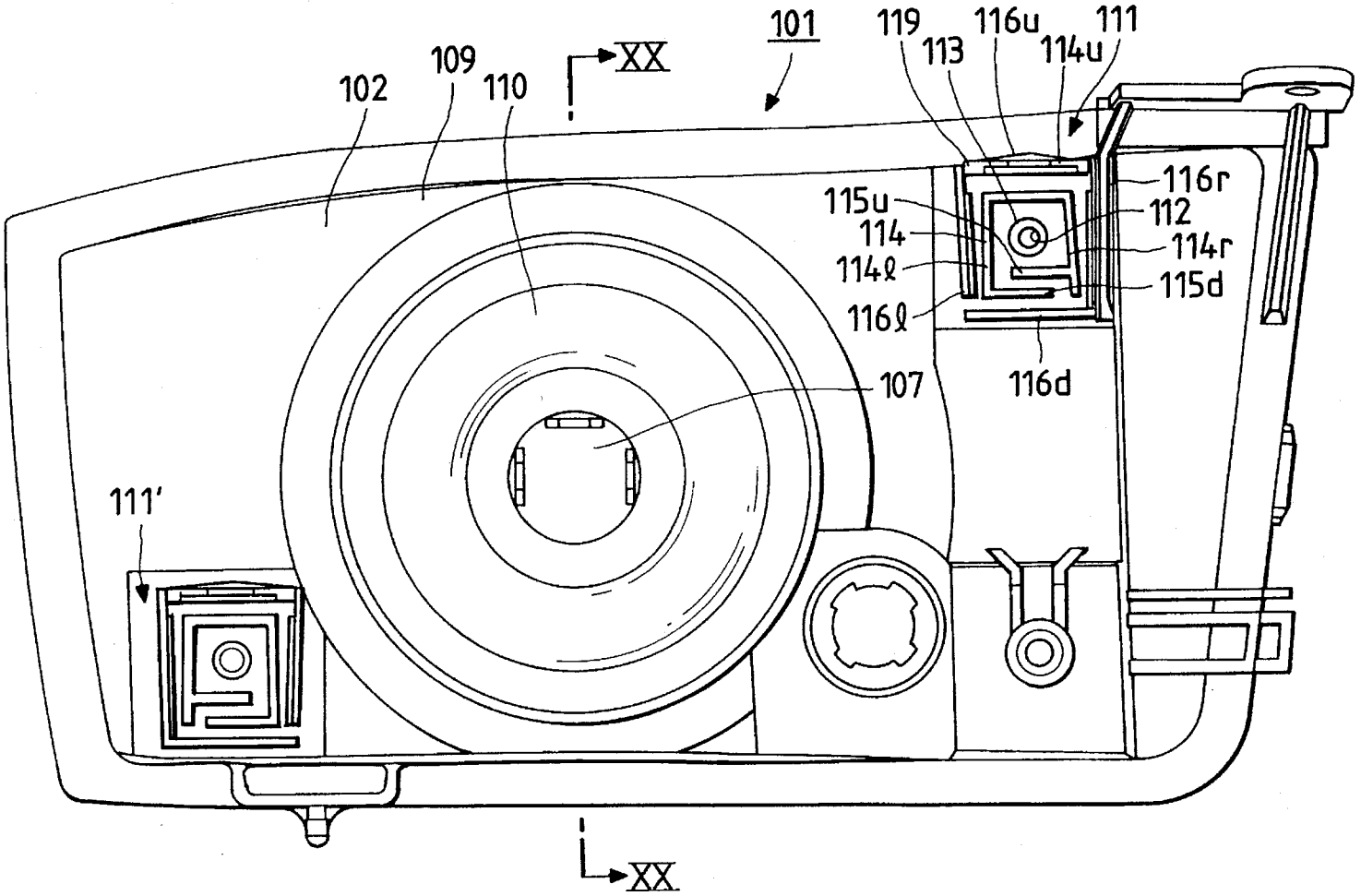
FIG. 19 is an enlarged back view of the main portions of a fifth embodiment of a vehicular lamp according to the invention, showing a state thereof in which a lid member is opened.

Ventilation systems $\mathbf{111}_1$ and $\mathbf{111}_2$ shown in FIG. 19 are formed in the upper right portion and in the lower left portion in FIG. 19 when they are viewed from behind the rear surface of the rear walls 109 of the lamp body 102. Since the ventilation systems $\mathbf{111}_1$ and $\mathbf{111}_2$ are arranged such that the respective components thereof are substantially similar in structure to each other, description will be given below mainly of the structure of the ventilation system $\mathbf{111}_1$ provided in the upper right of FIG. 19, whereas description will be almost omitted of the structure of the ventilation system $\mathbf{111}_2$ provided in the lower left of FIG. 19.

FIGS. 21 to 26 respectively show the ventilation system $\mathbf{111}_1$ in an enlarged manner.

In these figures, a circular communication hole 112 is formed in the rear wall 109. A cylindrical portion 113 is formed integrally with the communication hole 112 in such a manner that it extends from the opening edge thereof toward the back and forth direction thereof.

Figure 23:
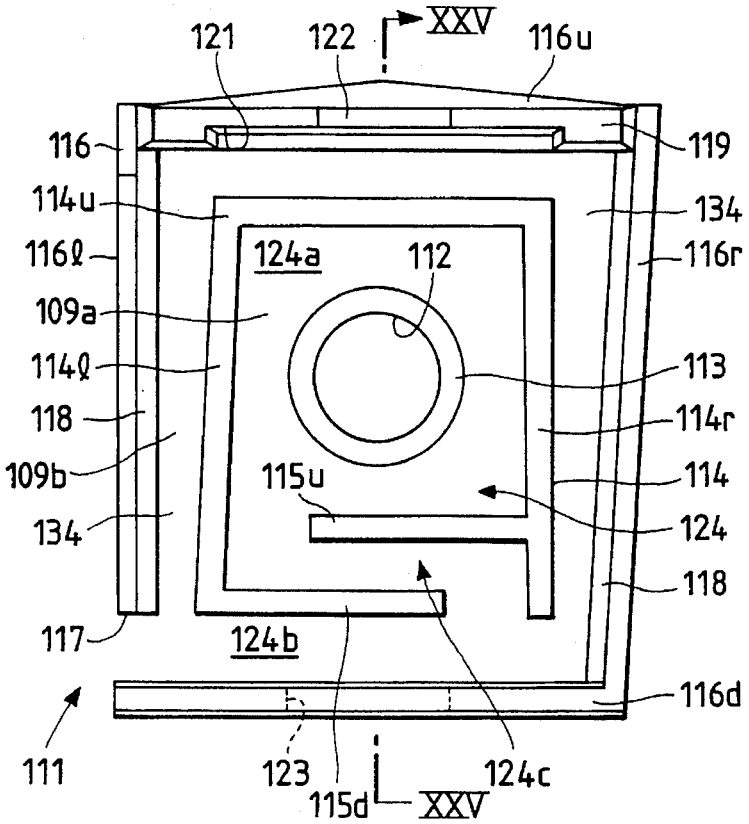
FIG. 23 is an enlarged back view of the main portions of the fifth embodiment, showing a state thereof in which a lid member is opened.
Figure 24:
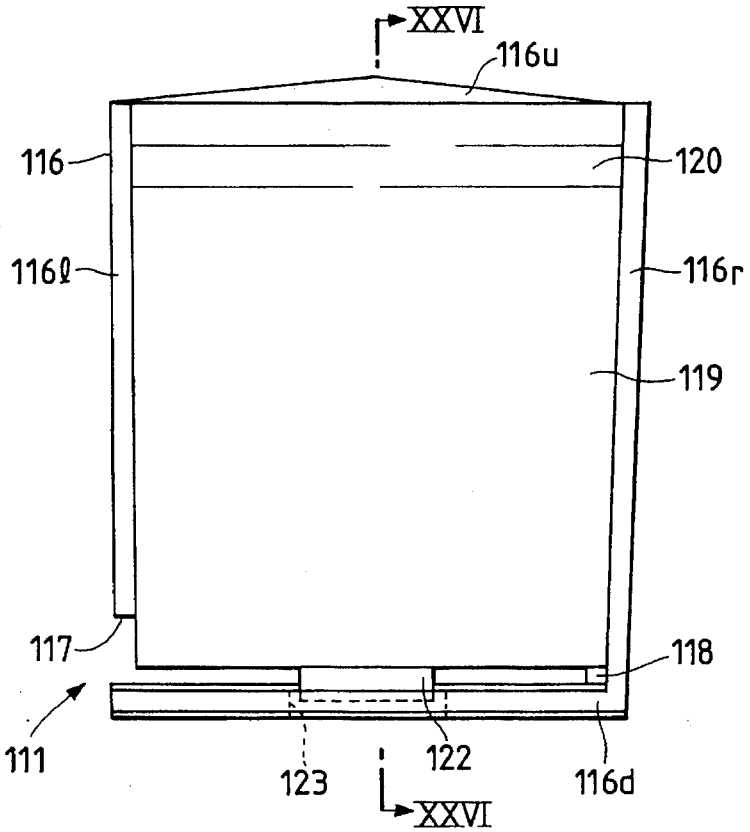
FIG. 24 is an enlarged back view of the main portions of the fifth embodiment, showing a state thereof in which a lid member is closed.

A inner peripheral wall 114 is formed integrally with the rear wall 109 in such a manner that it projects backwardly from the rear surface of the rear wall 109. The inner peripheral wall 114 is disposed such that it encloses the cylindrical portion 113. Further, the first peripheral wall 114 includes an upper waves wall 114*u* provided upwardly of the cylindrical portion 113, a right peripheral wall 114*r* extending downwardly from the right end of the upper peripheral wall 114*u*, and a left peripheral wall 114*l* extending downwardly from the left end of the upper peripheral wall 114*u*, while the three peripheral walls are formed integrally with one another. As shown in FIG. 23, the right peripheral wall 114*r* is inclined such that it shifts to the right as it goes downwardly, while the left peripheral wall 114*l* is inclined such that it shifts to the left as it goes downwardly.

An upper and a lower water preventive walls 115*u* and 115*d* are formed integrally with the rear wall 109 in such a manner that they project backwardly from the rear surface of the rear wall 109. The upper water preventive wall 115*u* extends to the left from a position slightly above the lower end of the right peripheral wall 114*r* and terminates before the left peripheral wall 114*l*, whereas the water preventive wall 115*d* extends to the right from the lower end of the left peripheral wall 114*l* and terminates before the lower end of the right peripheral wall 114*r*. That is, there is formed a passage 115 between the upper and lower water preventive walls 115*u* and 115*d*.

The amounts of projection of the inner peripheral wall 114 as well as water preventive walls 115*u* and 115*d* from the rear surface of the rear wall 109 are set substantially equal to one another, whereas the amount of projection of the cylindrical portion 113 from the rear surface of the rear wall 109 is set smaller than those of the inner peripheral wall 114 and upper and lower water preventive walls 115*u* and 115*d*.

An outer peripheral wall 116 encloses the periphery of the inner peripheral wall 114 and consists of four integrally formed portions 116*u*, 116*r*, 116*l* and 116*d* which respectively project backwardly from the rear surface of the rear wall 109. That is, the upper outer peripheral wall 116*u* is positioned upwardly of the upper peripheral wall 114*u*, the right outer peripheral wall 116*r* is positioned on the right of the right peripheral Wall 114*r*, the left outer peripheral wall 116*l* is positioned on the left of the left peripheral wall 114*l*, and the lower outer peripheral wall 116*d* positioned downwardly of the lower water preventive wall 115*d*.

The respective upper portions of the left outer peripheral wall 116*l* and right outer peripheral wall 116*r* are arranged to continue with the right an left end portions of the upper outer peripheral wall 116*u*, while the lower end portion of the right outer peripheral wall 116*r* is arranged to continue with the right end portion of the lower outer peripheral wall 116*d*. And, the length of the left outer peripheral wall 116*l* in the vertical direction thereof is set shorter than the length of the right outer peripheral wall 116*r* in the vertical direction thereof, while the height of the lower end portion of the left outer peripheral wall 116*l* is greater than the height of the lower end portion of the right outer peripheral wall 116*r*, whereby there is formed a cut-away portion 117 between the lower end portion of the left outer peripheral wall 116*l* and the portion of the lower outer peripheral wall 116*d* located near the left end portion thereof.

The amounts of projection of the respective outer peripheral walls 116*r*, 116*l* and 116*d* except for the upper outer peripheral wall 116*u* from the rear surface of the rear wall 109 are set larger than those of the inner peripheral wall 114 and upper and lower water preventive walls 115*u* and 115*d*.

The right outer peripheral wall 116*r* is inclined such that it shifts to the right as it goes upwardly, while the left outer peripheral wall 116*l* is inclined such that it shifts to the left as it goes upwardly. And, the outer peripheral walls 116*r* and 116*l* respectively include, on their mutually opposing surfaces, stepped portions 118, 118 which face backwardly. The stepped portions 118, 118 are provided slightly before the rear ends of the inner peripheral wall 114 and upper and lower water preventive walls 115*u* and 115*d*.

Figure 25:
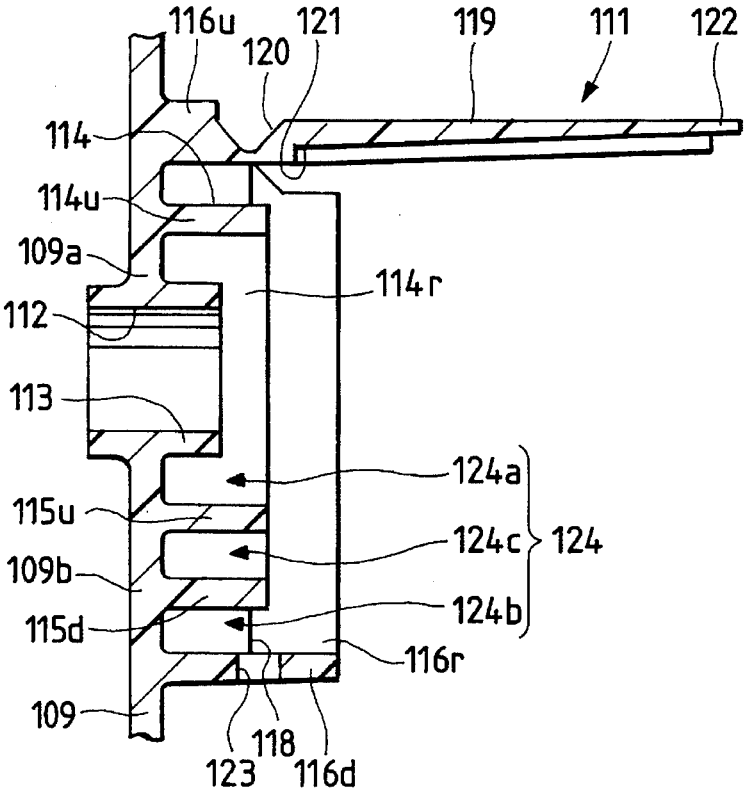
FIG. 25 is a section view taken along the line XXV—XXV shown in FIG. 23.
Figure 26:
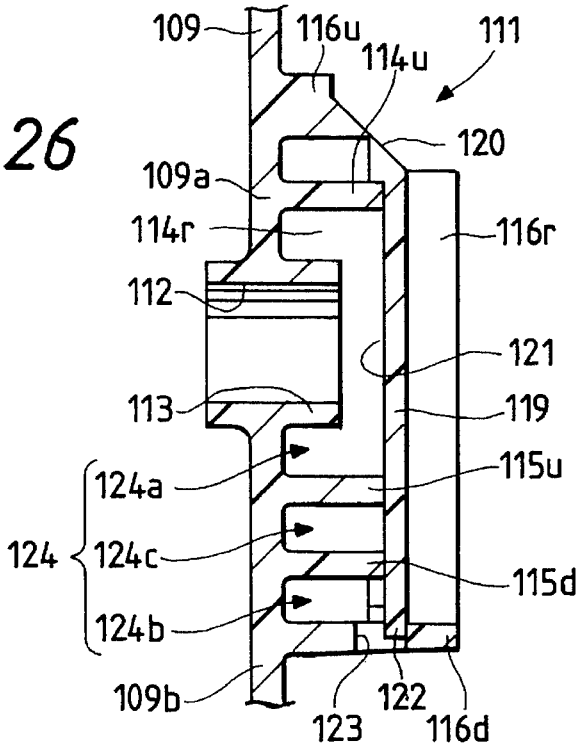
FIG. 26 is a section view taken along the line XXVI—XXVI shown in FIG. 24.

A lid member 119 is formed integrally with the rear end edge of the upper outer peripheral wall 116*u* through an integral-type hinge 120 having a small thickness (see FIGS. 25 and 26). The lid member 119 is formed in a plate which is one size larger than the area enclosed by the inner peripheral wall 114. And the lid member 119 includes, on its surface opposed to the rear wall 109, a great and shallow recessed portion 121. The recessed portion 121 has a size which allows the rear end portion of the inner peripheral wall 114 to be stored completely in the recessed portion 121.

The lid member 119 includes an engaging piece 122 in the leading end portion thereof, that is, in the central portion in the right and left direction of the end thereof opposite to the end thereof connected to the upper outer peripheral wall 116*u* by the hinge 120.

At a position near the rear end of the lower outer peripheral wall 116*d*, there is formed an elongated engaging hole 123 which extends in the right and left direction of the lower outer peripheral wall 116*d*.

Accordingly, the lid member 119 is bent at substantially right angles at the portion of the hinge 120 and is thus positioned so that it covers the inner peripheral wall 114 and water preventive walls 15*u*, 15*d*, and the engaging piece 122 is engaged with the engaging hole 123 formed in the lower outer peripheral wall 116*d*, whereby the lid member 119 is maintained in a state in which it covers the rear portions of the inner peripheral wall 114 and water preventive walls 115*u* and 115*d*. In this state, the rear end portions of the inner peripheral wall 114 and water preventive walls 115*u*, 115*d* are provided within the recessed portion 121 formed in the lid member 119, while the right and left side edges of the lid member 119 are respectively in contact with the stepped portions 118, 118 of the right and left outer peripheral walls 116*r*, 116*l*.

Thus, between the lamp chamber 105 and the outside of lamp body 102, in particular, in a portion enclosed by the cylindrical portion 113, the rear surface of the rear wall 109, inner peripheral wall 114, water preventive walls 115*u* and 115*d*, outer peripheral wall 116, and lid member 119, there is formed a maze of ventilation passage 124 which is in communication with the communication hole 112.

In other words, the ventilation passage 124 includes a first space 124*a*, a second space 124*c* and a third space 124*b*: the first space 124*a* is defined by the cylindrical portion 113 formed continuous with the communication hole 112, inner peripheral wall 114 and upper and lower water preventive walls 115*u*, 115*d*, a portion 109*a* of the rear wall 109 divided by these elements, and lid member 119; the second space 124*c* is defined by the lid member 119 and the upper and lower water preventive walls 115*u*, 115*d*; and, the third space 124*b* is defined by the inner peripheral wall 114 and outer peripheral wall 116, a portion 109*b* of the rear wall 109 divided by these walls, and lid member 119. The first and third spaces 124*a* and 124*b* are in communication with each other through the second space 124*c*, while the third space 124*b* is in communication with the atmosphere through the cut-away portion 117. Additionally, fourth space 134 defined by the inner peripheral wall 114 and outer peripheral wall 116 merge with the third space 124*b*.

Accordingly, in the present headlamp 101, not only the lid member 119 is formed integrally with the upper outer peripheral wall 116*u*, but also there is formed the ventilation passage 124 of a triple structure including the first space 124*a* formable when the lid member 119 covers the inner peripheral wall 114 and water preventing walls 115*u* and 115*d*, the second space 124*c* formable when the lid member 119 covers the inner peripheral wall 114 and water preventing walls 115*u* and 115*d*, and the third space 124*b* formable when the lid member 119 is in contact with the inner surface of the outer peripheral wall 116, so that a sufficient water preventive measure can be taken.

For example, even if water splashes on the ventilation system $\mathbf{111}_1$ or $\mathbf{111}_2$, such water can be prevented by the outer peripheral wall 116, especially, by the lower outer peripheral wall 116*d*.

Even if water happens to invade into the ventilation passage 124 through the cut-away portion 117 of the outer peripheral wall 116, because the cut-away portion 117 and the opening of the second space 124*c* are positioned with respect to each other that they are not opposed to each other, the water can hardly ever invade from the third space 124*b* into the first space 124*a* and, even if the water tries to invade into the first space 124*a*, the water is prevented by the upper water preventive wall 115*u* and cylindrical portion 113, thereby being able to prevent the water from arriving at the lamp chamber 105.

Although water often splashes from the right and left sides of the vehicular lamp, in the above-mentioned ventilation system $\mathbf{111}_1$ or $\mathbf{111}_2$, since the cut-away portion 117 faces the central side of the vehicular lamp (that is, it faces the side of the vehicular lamp near the opening 108 of the light bulb 107, the water is difficult to enter the vehicular lamp in this respect as well.

Because the inner peripheral wall 114 and outer peripheral wall 116 are formed of synthetic resin, there arise a problem as to the sealed condition between these two walls. However, this problem can be solved according to the present embodiment in the following manner. That is, according to the present embodiment, the inner surface of the lid member 119 is in contact with the rear end of the inner peripheral wall 114, the side edge portions of the lid member 119 are in contact with the inner surfaces of the outer peripheral wall 116, and the directions of contact of the lid member 119 with the inner peripheral wall 114 and outer peripheral wall 116 are different from each other.

Therefore, according to the present embodiment, if the lid member 119 is closely contacted with the inner peripheral wall 114 and outer peripheral wall 116 to a sufficient degree, then a waterproof property can be enhanced. On the other hand, in a structure in which the inner surfaces of the lid member 119 are simply in contact with the projecting end of the inner peripheral wall 114 and the projecting end of the outer peripheral wall 116, if the amounts of the backward projection of the inner peripheral wall 114 and outer peripheral wall 116 are not set almost equal to each other with a high accuracy, there is a danger that there can be produced a gap between the lid member 119 and inner peripheral wall 114 or outer peripheral wall 116 and water can invade through the gap. However, according to the present embodiment, as described above, since the directions of contact of the lid member 119 with the inner peripheral wall 114 and outer peripheral wall 116 are set different from each other, the lid member 119 can be brought into sufficiently close contact with the inner peripheral wall 114 and outer peripheral wall 116 without requiring the above high accuracy in forming the inner peripheral wall 114 and outer peripheral wall 116.

As described above, since the lamp chamber 105 is in communication with the outside of the vehicular lamp through the maze-like ventilation passage 124, only the flow-in and flow-out of the air are permitted between the lamp chamber 105 and the outside. Therefore, even if the lens 104, reflector 106 and the like can get fogged, such fogging can be removed quickly. Especially, in the headlamp 101, since one ventilation system $\mathbf{111}_1$ is provided in the upper right and the other ventilation system $\mathbf{111}_2$ is provided in the lower left, the air can flow evenly within the lamp chamber 105 in the course of ventilation system $\mathbf{111}_2$→lamp chamber 105→ventilation system $\mathbf{111}_1$.

If the sectional area of the second space 123*c* allowing the first and third spaces 124*a* and 124*b* of the ventilation system 124 to communicate with each other is set substantially equal to the sectional area of the communication hole 112, then there can be secured an amount of air flow corresponding to the amount of air flow in the communication hole 112, so that a sufficient amount of air can be flown into the lamp chamber 105.

Because the components of the ventilation system $\mathbf{111}_1$ or $\mathbf{111}_2$ are all formed integrally with the lamp body 102, the cost of the vehicular lamp can be reduced. Further, the reason why the right and left peripheral walls 114*r* and 114*l* are inclined in the opposite direction to the right and left outer peripheral walls 116*r* and 116*l* is to make it possible to remove a metal mold which is used to mold the recessed portion 121 of the lid member 119.

Figure 27:
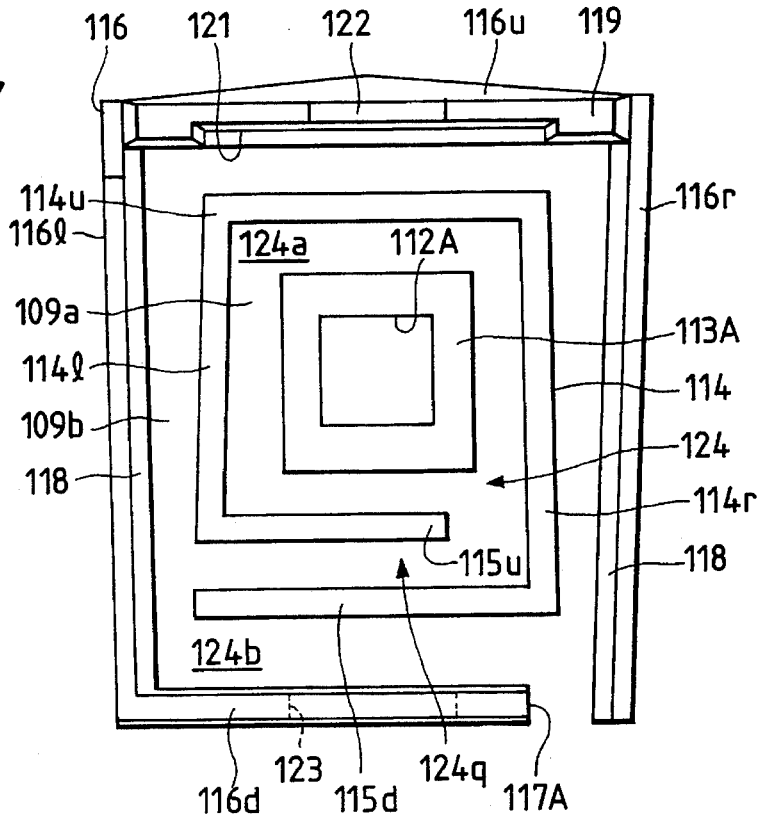
FIG. 27 is an enlarged back view of a modification of the fifth embodiment, in which the position of a passage between a cylindrical portion and a water preventive wall and the position of the cut-away portion of the outer peripheral wall are different from the fifth embodiment.
Figure 29:
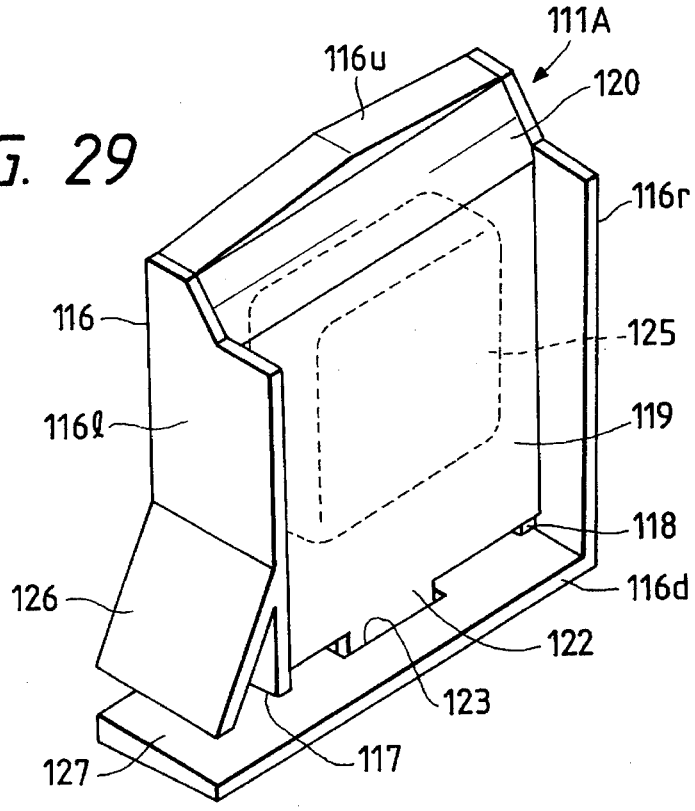
FIG. 29 is a perspective view of the main portions of the sixth embodiment, showing a state thereof in which a lid member is closed.
Figure 28:
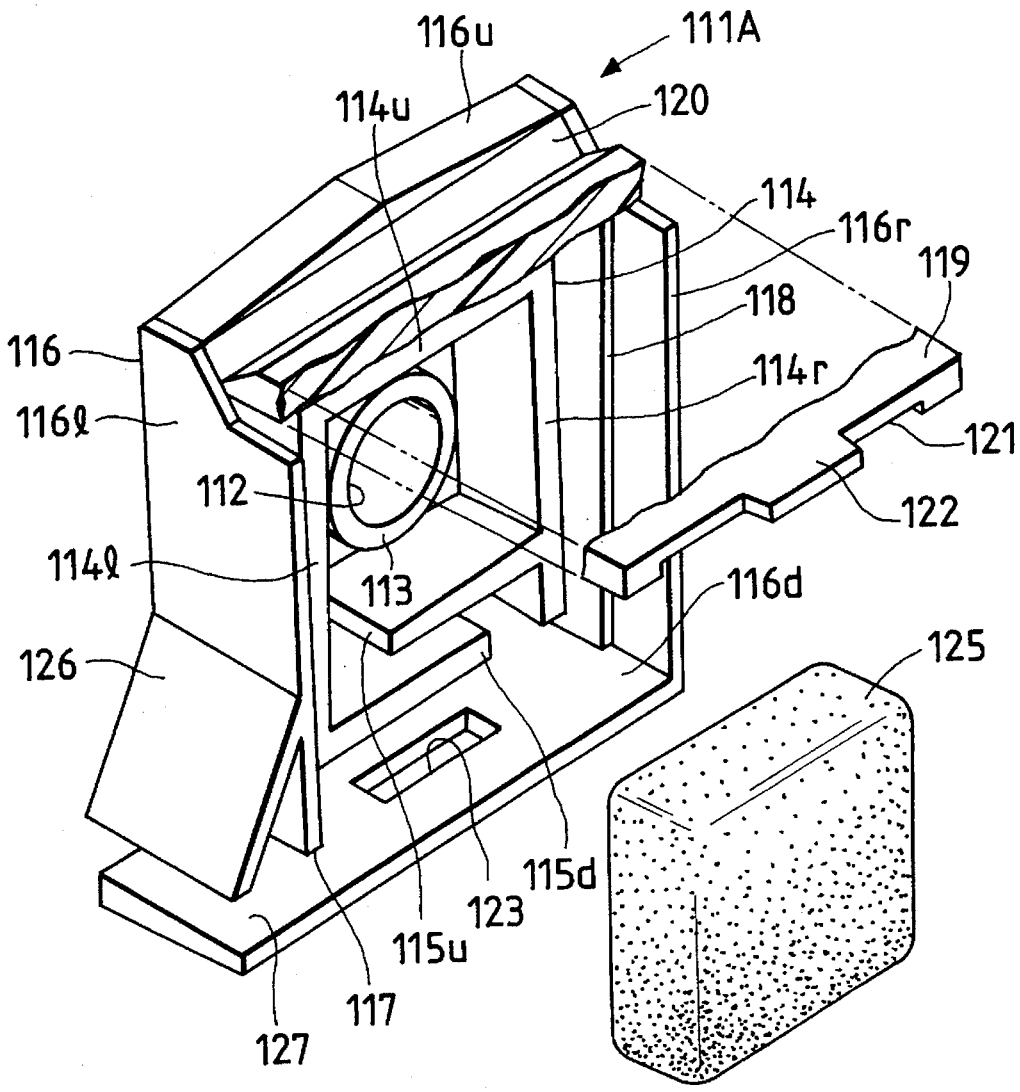
FIG. 28 is a perspective view of the main portions of a sixth embodiment of a vehicular lamp according to the invention, showing a state thereof in which a lid member is opened and is in part cut away and the lid member is also shown together with a filter.
Figure 30:
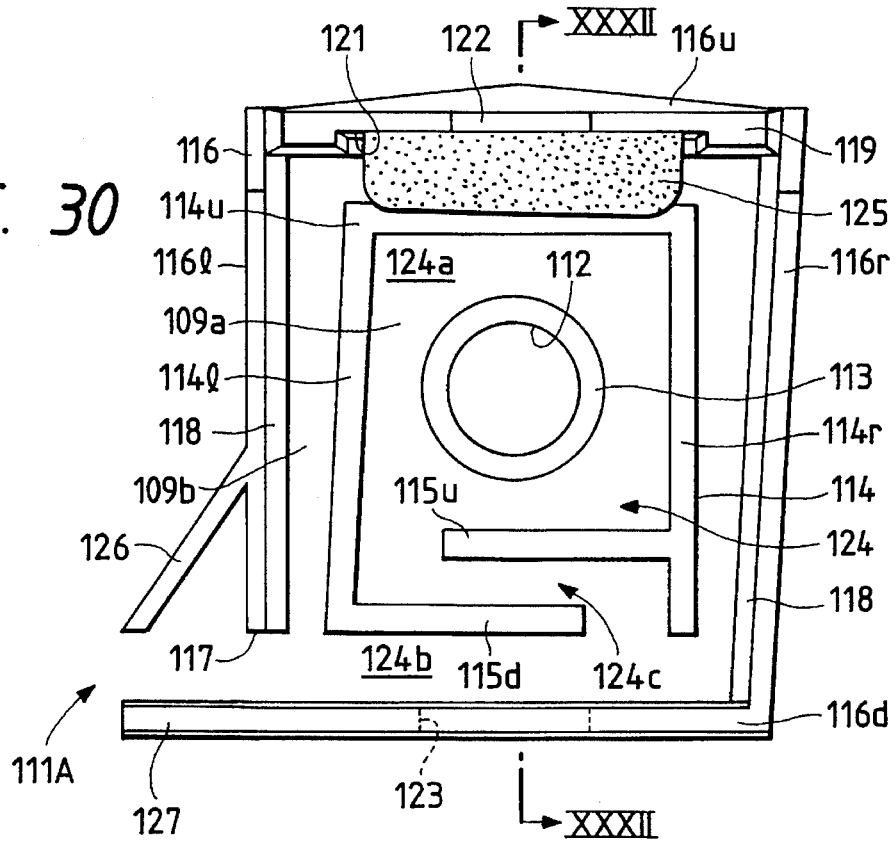
FIG. 30 is an enlarged back view of the main portions of sixth embodiment, showing a state thereof in which a lid member is opened.
Figure 31:
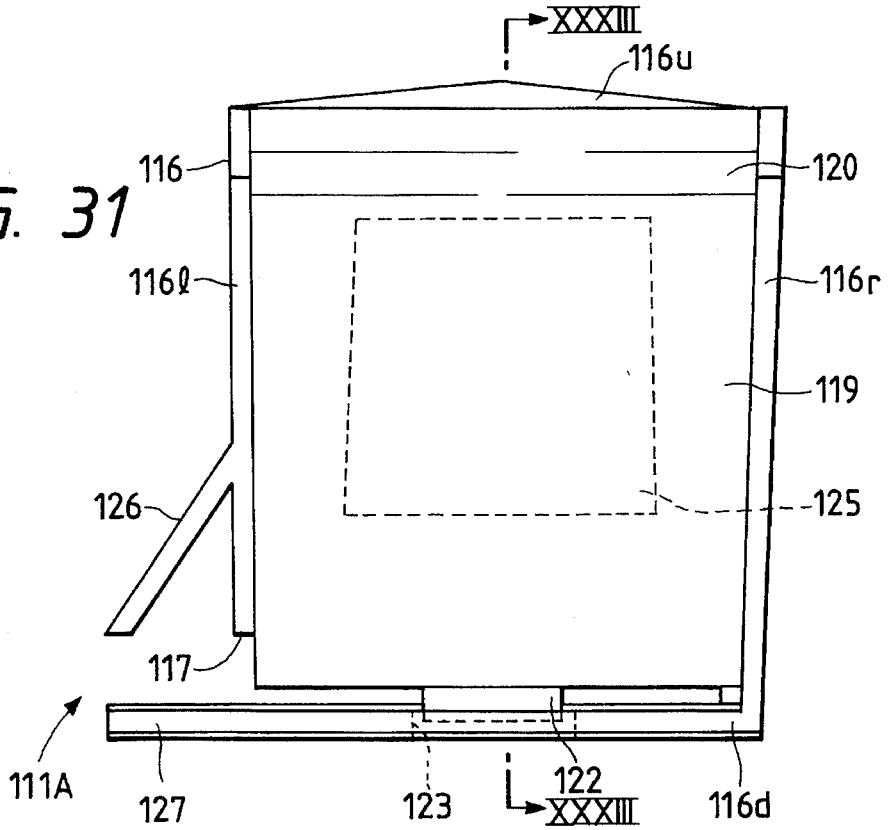
FIG. 31 is an enlarged back view of the main portions of the sixth embodiment, showing a state thereof in which a lid member is closed.
Figure 32:
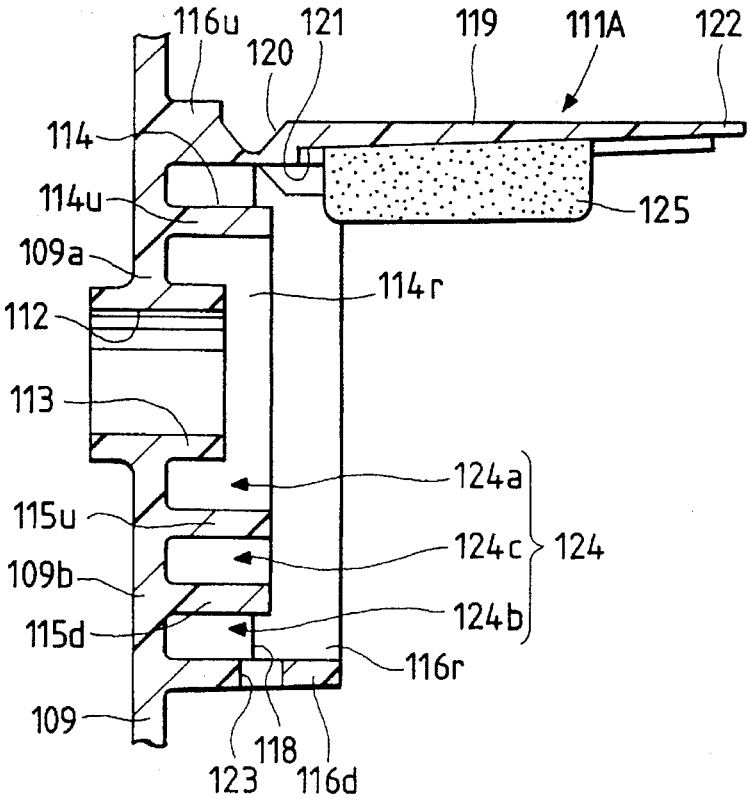
FIG. 32 is a section view taken along the line XXXII—XXXII shown in FIG. 30.

Although the cylindrical portion 113 of the communication hole 112 is formed in a cylindrical shape in the fifth embodiment 101, like a square portion 13A shown in FIG. 27, it can also be formed in a square shape enclosing a square-shaped communication hole 112A. Also, the upper water preventive wall 115*u* can be so formed as to extend to the right continuously from the lower end of the left peripheral wall 114*l* before the right peripheral wall 114*r*, and the water preventive wall 115*d* can be so formed as to extend to the left continuously from the lower end of the right peripheral wall 114*r*, whereby the second space 124*c* allowing the first and third spaces 124*a* and 124*b* to communicate with each other, like a space 124*q* shown in FIG. 27, can be structured such that it includes an opening facing in the horizontal direction. However, in the structure as it is, water or the like is easy to invade into the space 124*q* through the cut-away portion 117 of the outer peripheral wall 116 and, therefore, the cut-away portion 117 and the opening of the space 124*q* must be positioned such that they are not opposed to each other. For example, as shown in FIG. 27, a cut-away portion 117A may be formed in the lower right portion of the outer peripheral wall 116.

In the vehicular lamp 101 according to the fifth embodiment of the invention, the lid member 119 is formed integrally with the upper outer peripheral wall 116*u*. However, this is not limitative but, of course, the lid member may be formed in the other portion of the outer peripheral wall 116 (for example, the lid member 119 may be formed integrally with the right outer peripheral wall 116*r* to thereby provide a cover structure which is opened in the horizontal direction).

FIGS. 28 to 33 show a sixth embodiment of a vehicular lamp according to the invention. The sixth embodiment is different from the above-mentioned fifth embodiment only in that a dustproofing filter is disposed in the first space of the ventilation system and a water preventive wall is provided in the outer peripheral wall, and thus only the ventilation system 111A thereof is shown. Since the ventilation system 111A is almost identical with the above-mentioned ventilation system $\mathbf{111}_1$, the same parts thereof are given the same designations as in the ventilation system $\mathbf{111}_1$ and thus the description thereof is omitted here. Also, this way of omitting the description will apply similarly to a seventh embodiment of a vehicular lamp according to the invention which will be described later.

A dust filter 125 is used to prevent dust or the like in the air from invading into the lamp chamber 105 and is formed of soft urethane sponge in a rectangular parallelepiped. In order that, when the lid member 119 is closed, the filter 125 can be fitted with the inside of the portions of the first space 124*a* of the ventilation systems 124, the filter 125 is bonded to the recessed portion 121 of the lid member 119 which corresponds to the above portions of the first space 124*a* by use of a double adhesive tape, an adhesive or the like.

A pair of upper and lower waterproof flanges 126 and 127 are formed integrally with the outer walls 116. The upper water preventive flange 126 is formed integrally with a left outer peripheral wall 116*l* in such a manner that it is slanted downwardly to the left with respect to the outer surface of the left outer peripheral wall 116*l*, while the lower water preventive flange 127 is formed integrally with a lower outer peripheral wall 116*d* by extending the left end portion of the lower outer peripheral wall 116*d* to the left. When the amounts of the leftward projection of the water preventive walls 126 and 127 are compared with each other, the amount of the leftward projection of the water preventive flange 127 is set slightly smaller than that of the water preventive flange 126.

The upper water preventive flange 126 plays the role of preventing water or the like flying from above or from laterally from invading into the third space 124*b* through the cut-away portion 117 of the outer peripheral wall 116, whereas the lower water preventive flange 127 plays the part of preventing water or the like splashing from below from invading into the third space 124*b* through the cut-away portion 117 of the outer peripheral wall 116.

Figure 33:
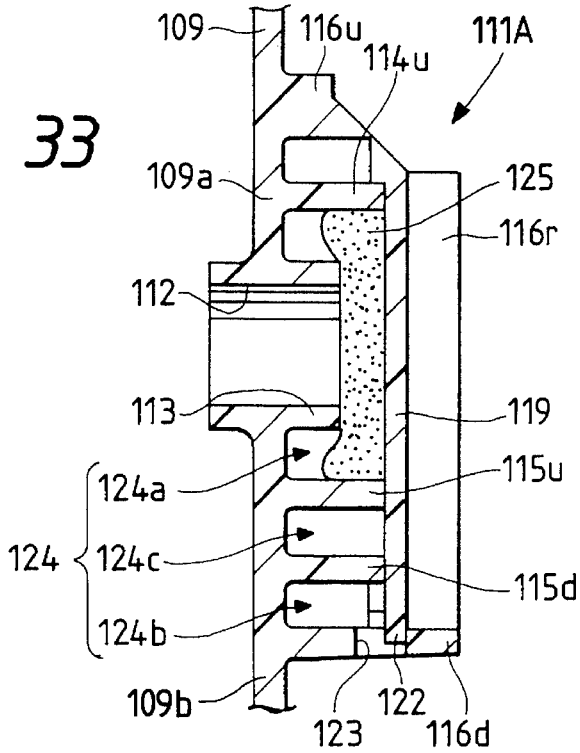
FIG. 33 is a section view taken along the line XXXIII—XXXIII shown in FIG. 31.

Accordingly, in the present sixth embodiment, if the lid member 119 is closed, then the filter 125 is fitted into the portions of the first space 124*a* except for the second space 124*c* (see FIGS. 32 and 33), thereby being able to prevent dust or the like from invading into the lamp chamber 105 as the air flows in. And, as shown in FIG. 33, if the filter 125 is positioned within the first space 124*a*, then the filter 125 is partially compressed between the cylindrical portion 113 of the communication hole 112 and lid member 119. Therefore, as the filter 125 goes from the second space 124*c* to the communication hole 112, the density of the filter pores is gradually increased so that dust or the like can be made to adhere to the whole filter uniformly, thereby being able to enhance the dustproof effect of the vehicular lamp. In other words, while only the dustproof object can be achieved simply by disposing the filter 125 within the first space 124*a*, the reason why the filter 125 is bonded to the recessed portion 121 of the lid member 119 as in the present embodiment is not only to prevent removal of the filter 125 but also to assure that the density distribution of the filter pores provides a planned uniform distribution.

Figure 34:
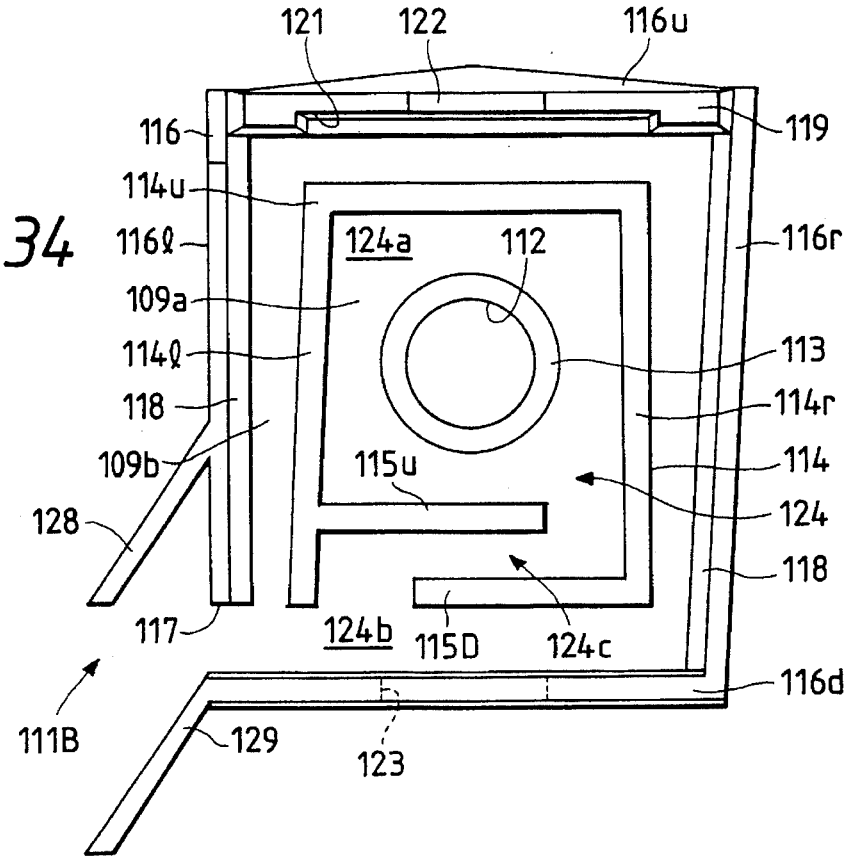
FIG. 34 is an enlarged back view of the main portions of a seventh embodiment of a vehicular lamp according to the invention, showing a state thereof in which a lid member is opened; and, FIG. 35 is an enlarged back view of the main portions of the seventh embodiment, showing a state thereof in which a lid member is closed.
Figure 35:
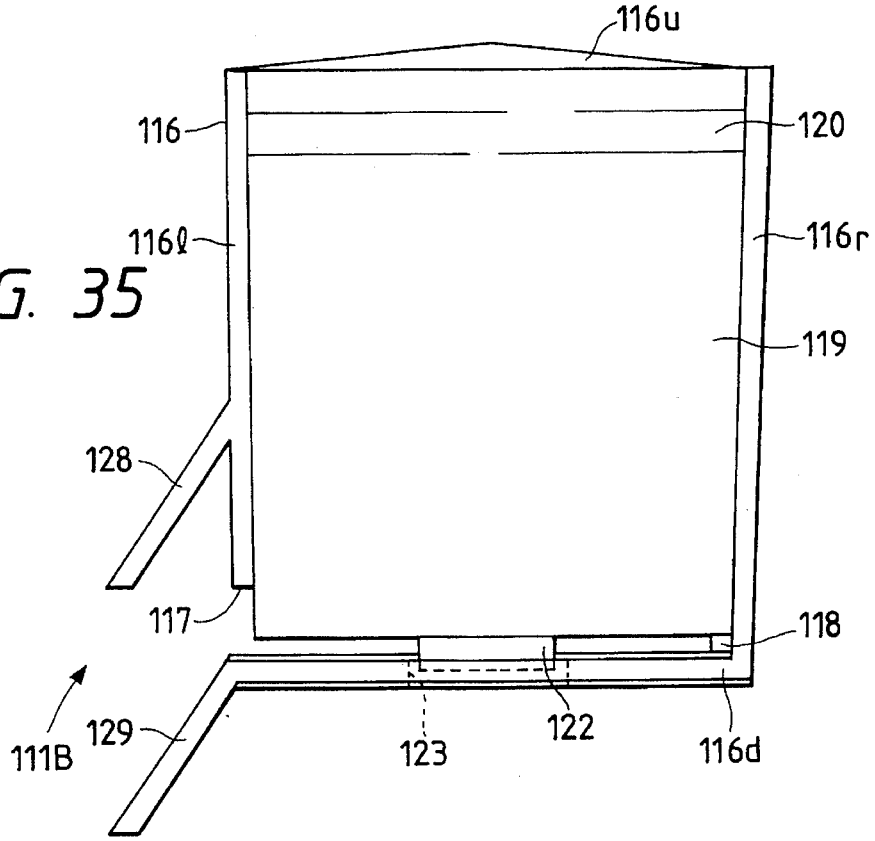

FIGS. 34 and 35 show a seventh embodiment of a vehicular lamp according to the invention. The seventh embodiment is different from the above-mentioned fifth embodiment only in the shapes of the outer peripheral walls and water preventive walls in the ventilation system, and thus only the ventilation system 111B is shown here.

The ventilation system shown in FIGS. 34 and 35 is provided with an upper and lower water preventive walls 115U and 115D. The upper water preventive wall 115U extends to the right from a position slightly above the lower end of the left peripheral wall 114*l* and terminates before the right peripheral wall 114*r*. On the other hand, the lower other water preventive wall 115D extends to the left from the lower end of the right peripheral wall 114*r* and terminates before the lower end of the left peripheral wall 114*l*. And, there is formed a second space 124*c* between the upper and lower water preventive walls 115U and 115D.

An upper and lower water preventive flanges 128 and 129 are formed integrally with the outer peripheral wall 116. The upper water preventive flange 128 is formed integrally with a left outer peripheral wall 116*l* in such a manner that it is slanted downwardly to the left with respect to the outer peripheral wall 116*l*, while the water preventive flange 129 is formed integrally with a lower outer peripheral wall 116*d* by extending the left end portion of the lower outer peripheral wall 116*d* downwardly to the left. When the amounts of the leftward projection of the water preventive flanges 128 and 129 are compared with each other, the amount of the leftward projection of the water preventive flange 129 is set equal to or slightly smaller than that of the upper water preventive flange 128.

Accordingly, the upper water preventive flange 128 plays the role of preventing water or the like flying from above or from laterally the vehicular lamp from invading into the third space 124*b* through the cut-away portion 117 of the outer peripheral wall 116, whereas the lower water preventive flange 129 plays the part of preventing water or the like splashing from below the vehicular lamp from invading into the third space 124*b* through the cut-away portion 117 of the outer peripheral wall 116.

As described above, according to the vehicular lamp of the present invention having a ventilation system which includes a lamp chamber defined by and between a lens and a lamp body and a communication hole formed in the lamp body in such a manner that it allows the lamp chamber and the outside thereof to communicate with each other, the lamp includes the following structures (a) to (i):

(a) a inner peripheral wall portion projects from the rear surface of the lamp body in such a manner that it is provided upwardly of as well as on the right and left sides of the communication hole, while a pair of upper and lower water preventive walls projecting downwardly of the communication hole is included in part of the first peripheral wall portion;

(b) an outer peripheral wall portion enclosing the first peripheral wall portion is provided on and projecting from the rear surface of the lamp body, and a lid member so provided as to cover the projecting end side of the first peripheral wall portion is formed integrally with the second peripheral wall portion;

(c) the lid member contacts to the first peripheral wall portion to thereby define a first space between the lamp body, lid member and first peripheral wall portion, and the first space communicates through the communication hole with the lamp chamber;

(d) the lid member contacts to the first peripheral wall portion to thereby define a second space between the lamp body, lid member and upper and lower water preventive walls;

(e) the lid member contacts to the first and second peripheral wall portions to define a third space between the lamp body, lid member, the lower water preventive wall and the second peripheral wall portion;

(f) the lid member is contacted with the second peripheral wall portion to thereby define a fourth space between the lamp body, lid member, first peripheral wall portion, and second peripheral second wall portion;

(g) the first space communicates with the second space through a first communication passage formed in the portion of the first peripheral wall portion located near the bottom of the first peripheral wall portion;

(h) the second space communicates with the third space through a second communication passage formed in the portion of the first peripheral wall portion located opposite to the first communication passage; and (i) the third space merges with the fourth space and communicate with the atmosphere through a second communication passage which is formed in the portion of the second peripheral portion located near the bottom thereof and also which is formed at a position not opposed to the opening of the first communication passage.

Therefore, the vehicular lamp according to the present invention does not require a separate member such as a waterproof pipe to thereby be able to reduce the cost of the vehicular lamp and, at the same time, there is eliminated the need for provision of an excessively bent portion in the ventilation passage allowing the inside and outside of the lamp chamber to communicate with each other to thereby be able to assure the smooth flow of the air. Also, due to the fact that the sectional area of the portion defined by the leading end edges of the water preventive walls and the side surfaces of the peripheral walls of the ventilation passage is set substantially equal to the sectional area of the communication hole, it is possible to secure an amount of air flow corresponding to the size of the communication hole.

Due to the fact that the first and second peripheral wall portions are provided in the rear wall of the lamp body and the opening of the second passage is formed to face the central side of the vehicular lamp, water coming from the lateral sides of the vehicular lamp due to splashing or the like is difficult to invade into the opening of the second passage.

Since a dustproofing filter is provided within the first space, dust or the like is prevented from invading into the lamp chamber.

The shapes and structures of the respective parts shown in the above-mentioned respective embodiments are only the typical examples of the invention and thus the technical scope of the invention is not limited to them.

What is claimed is:

1. A vehicular lamp having a ventilation system, comprising a lamp body having a front opening;

a lens mounted onto said front opening of said lamp body;

a lamp chamber defined by said lamp body and said lens; and a ventilation system comprising:

a communication hole formed in said lamp body;

a first peripheral wall projecting from a rear surface of said lamp body at a position where said first peripheral wall surrounds said communication hole;

an upper and lower water preventive walls projecting from said first peripheral wall downwardly of said communication hole;

a second peripheral wall surrounding said first peripheral wall, said second peripheral wall projecting from the rear surface of said lamp body;

a lid member engaging with said second peripheral wall for covering said first and second peripheral walls;

a first space defined between said lamp body, said lid member and said first peripheral wall, said first space communicating through said communication hole with said lamp chamber;

a second space defined between said lamp body, said lid member and said upper and lower water preventive walls, said second space communicating with said first space through a first communication passage formed at a first position in the lateral direction; and a third space defined between said lamp body, said lid member, said lower water preventive wall and said second peripheral wall, said third space communicating with said second space through a second communication passage formed at a second position opposite to said first position, said third space communicating with atmosphere.

2. The vehicular lamp according to claim 1, wherein said first peripheral wall is formed integrally with said upper and lower water preventive walls.

3. The vehicular lamp according to claim 1, wherein said lid member is formed integrally with said second peripheral wall through a thin hinge member.

4. The vehicular lamp according to claim 1, wherein the sectional area of each of said first and second communication passages is substantially equal to the sectional area of said communication hole.

5. The vehicular lamp according to claim 1, wherein said ventilation system is formed integrally with said lamp body.

6. The vehicular lamp according to claim 1, further comprising a filter fitted in said communication hole.

7. The vehicular lamp according to any one of claims 1 and 6, further comprising a filter fitted in said second space.

8. The vehicular lamp according to claim 1, wherein said ventilation system further comprises a fourth space defined between said lamp body, said lid member, said first peripheral wall and said second peripheral second wall, said fourth space merging with said third space.

9. The vehicular lamp according to claim 1, wherein said ventilation system further comprises an upper and lower water preventive flanges formed integrally with said second peripheral wall.

10. A ventilation system for a vehicular lamp, comprising:

a communication hole formed in the vehicular lamp;

a first peripheral wall projecting from a rear surface of the lamp at a position where said first peripheral wall surrounds said communication hole;

an upper and lower water preventive walls projecting from said first peripheral wall downwardly of said communication hole;

a second peripheral wall surrounding said first peripheral wall, said second peripheral wall projecting from the rear surface of the lamp;

a lid member engaging with said second peripheral wall for covering said first and second peripheral walls;

a first space defined between the lamp, said lid member and said first peripheral wall, said first space communicating through said communication hole with the lamp chamber;

a second space defined between the lamp, said lid member and said upper and lower water preventive walls, said second space communicating with said first space through a first communication passage formed at a first position in the lateral direction; and a third space defined between the lamp, said lid member, said lower water preventive wall and said second peripheral wall, said third space communicating with said second space through a second communication passage formed at a second position opposite to said first position, said third space communicating with atmosphere.

* * * * *